US006590562B2

(12) United States Patent
Yamazaki et al.

(10) Patent No.: US 6,590,562 B2
(45) **Date of Patent: *Jul. 8, 2003**

(54) ACTIVE MATRIX DISPLAY AND IMAGE FORMING SYSTEM

(75) Inventors: Shunpei Yamazaki, Tokyo (JP); Jun Koyama, Kanagawa (JP); Hidehiko Chimura, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/164,221

(22) Filed: Jun. 4, 2002

(65) Prior Publication Data

US 2002/0154089 A1 Oct. 24, 2002

Related U.S. Application Data

(63) Continuation of application No. 09/835,266, filed on Apr. 12, 2001, now Pat. No. 6,421,041, which is a continuation of application No. 08/639,563, filed on Apr. 29, 1996, now Pat. No. 6,219,022.

(30) Foreign Application Priority Data

Apr. 27, 1995 (JP) ..... 7-129429

(51) Int. Cl.[7] ..... G09G 3/36
(52) U.S. Cl. ..... 345/103

(58) Field of Search ..... 345/1, 99, 103, 345/94, 87, 92, 93, 98, 100; 348/383; 349/41, 42, 48, 73

(56) References Cited

U.S. PATENT DOCUMENTS

| | | | | |
|---|---|---|---|---|
| 3,071,706 A | | 1/1963 | Waldorf | |
| 3,787,834 A | | 1/1974 | Elliott | 345/103 |
| 4,804,951 A | | 2/1989 | Yamashita et al. | 345/94 |
| 4,824,212 A | | 4/1989 | Taniguchi | 345/103 |
| 4,859,997 A | * | 8/1989 | Bouron et al. | 345/204 |
| 5,136,282 A | | 8/1992 | Inaba et al. | 345/103 |
| 5,345,249 A | | 9/1994 | Biemans | 345/1 |
| 5,396,257 A | | 3/1995 | Someya et al. | 345/1 |
| 5,448,257 A | | 9/1995 | Margeson, III et al. | 345/103 |
| 5,512,915 A | | 4/1996 | Leroux | 345/103 |
| 5,655,940 A | | 8/1997 | Hodson et al. | 345/42 |
| 6,219,022 B1 | * | 4/2001 | Yamazaki et al. | 345/103 |

FOREIGN PATENT DOCUMENTS

| | | | | |
|---|---|---|---|---|
| JP | 3-125187 | * | 5/1991 | 348/793 |

* cited by examiner

*Primary Examiner*—Chanh Nguyen
(74) *Attorney, Agent, or Firm*—Fish & Richardson P.C.

(57) ABSTRACT

A plurality of partial image display portions are provided. Each of the partial image display portions is formed by at least one signal line driver circuits and at least one of scanning line driver circuits. Each partial image display portion displays a part of one frame of image. The whole one frame of image is displayed by all of the partial image display portions.

13 Claims, 23 Drawing Sheets

ACTIVE MATRIX DISPLAY AND IMAGE FORMING SYSTEM

This application is a continuation (and claims the benefit of priority under 35 USC 120) of U.S. application Ser. No. 09/835,266, filed Apr. 12, 2001, now U.S. Pat. No. 6,421,041, which is a continuation of U.S. application Ser. No. 08/639,563, filed Apr. 29, 1996 issued as U.S. Pat. No. 6,219,022 on Apr. 17, 2001. The disclosure of the prior applications are considered part of (and are incorporated by reference in) the disclosure of this application.

BACKGROUND OF THE INVENTION

1. Field of the Invention

The present invention relates to a display device adapted to display high-quality images, using high-speed, large amount of image data, such as HDTV and, more particularly, to an electrooptical liquid crystal display.

2. Description of the Related Art

The configuration of the prior art system for providing a display of an image is shown in FIG. 20. This system has an image reader 2001 such as a video camera. This image reader scans a desired image, which may be a still image or moving image, and produces output data. A display device 2002 such as an electrooptical liquid crystal display provides a display, using the output data from the image reader 2001, i.e., according to results of the scan, under control of a control unit connected between the display device 2002 and the image reader 2001.

An electrooptical active matrix liquid crystal display which is one example of the aforementioned display device is next described by referring to FIG. 21. This conventional active matrix liquid crystal display comprises a gate-side driver 2116, or a scanning line driver circuit, a source-side driver 2115, or a signal line driver circuit, and a pixel matrix 2105 consisting of a plurality of pixels arranged in rows and column.

The scanning line driver circuit 2116 is composed of a shift register 2102 and a sampling circuit 2103 consisting of complementary TFTs. The shift register 2102 comprises master-slave flip-flops consisting of complementary TFTs.

The scanning line driver circuit 2116 is composed of the shift register 2102 and a buffer circuit consisting of complementary TFTs. The shift register 2102 comprises master-slave flip-flops consisting of complementary TFTs.

The configuration of each pixel is shown in FIG. 22. An N-type TFT 2200 has a gate electrode 2202, a source electrode 2201, and a drain electrode 2203. A liquid crystal element 2204 and an auxiliary capacitor 2206 which are connected to the source electrode 2201 of the N-type TFT 2200 are connected with a counter electrode 2205 and ground 2207, respectively.

The operation of the prior art electrooptical active matrix liquid crystal display constructed as described above is described below. First, the operation of the driver on the gate side, or the scanning line driver circuit 2116, is described. When a start pulse on the gate side and a shift clock pulse on the gate side are entered, a gate signal line 2108 which is connected with a buffer 2107 goes low (L) and then high (H) in synchronism with the shift clock pulse on the gate side.

The operation of the driver on the source side, or the signal line driver circuit 2115, is next described. When a start pulse on the source side and a shift clock pulse on the source side are entered, a sampling signal line 2117 makes a transition from a low (L) level, to a high (H) level, and then to a low (L) level in synchronism with the shift clock pulse on the source side. An image signal entered through an analog RGB signal line 2110 is sampled according to the signal obtained from the sampling signal line 2117, and data about an image is supplied to source signal lines.

The whole active matrix display operates as follows. In order to write data in one horizontal direction, the data about the image is written to pixels on those horizontal lines whose gate signal lines are at a high (H) level in synchronism with the shift clock pulse on the source side. This operation is repeated vertically in synchronism with the vertical shift clock pulses on the gate side. These operations are performed for one frame of image. In this way, one frame of image is displayed. FIG. 23 is a timing diagram illustrating this series of operations.

The manner in which a display is provided by the prior art structure described thus far has some disadvantages, including: (1) The TFTs of the prior art liquid crystal display have small mobilities; and (2) It takes a long time to write data into liquid crystal pixels. For these and other reasons, it has been impossible to set the horizontal sampling clock frequency at a high value. As a consequence, it has been difficult to achieve high-speed operation. That is, it takes long times to change the states of the TFTs and the liquid crystal.

These undesirable phenomena become more conspicuous as area of the display screen is increased, i.e., the number of pixels is increased, because a larger amount of data is used.

Today, the amount of data about one frame of image is increased manyfold compared with conventional television, in order to achieve higher image quality as encountered in high-definition TV (HDTV) and EDTV. As the display area is increased, the visibility is improved. Also, a plurality of images can be displayed simultaneously on one display device. Hence, there is an increasing demand for larger area displays. To satisfy these requirements, electrooptical liquid crystal displays have been eagerly required to be operated at higher speeds.

SUMMARY OF THE INVENTION

It is an object of the present invention to provide a display device free from the foregoing problems.

One embodiment of the present invention is an active matrix display comprising: a plurality of pixels arranged in rows and columns; switching devices disposed at the pixels; scanning lines connected with the pixels and acting to turn on and off the switching devices; and signal lines connected to the pixels and acting to produce display signals. This active matrix display is characterized in that it has two kinds of line driver circuits consisting of at least one signal line driver circuit and at least one scanning line driver circuit, and that at least one of these two kinds of line driver circuits is plural in number. At least one signal line driver circuit and at least one scanning line driver circuit makes a pair that forms a partial image display portion. The display device has a plurality of such partial image display portions. Each of the partial image display portions displays a part of one frame of image. All the partial image display portions cooperate to display the whole one frame of image.

In one feature of the invention, one of the scanning and signal lines described above or both assume the form of a multilayer metallization structure.

In another feature of the invention, each of the above-described partial image display portions has an electrically independent counter electrode.

In a further feature of the invention, the above-described display device has an image data rearranging unit for converting input image data into data sets corresponding to the partial image display portions, respectively.

The novel display device has two kinds of line driver circuits consisting of at least one scanning line driver circuit and at least one signal line driver circuit. At least one of these two kinds of line driver circuit is plural in number. When the display device displays one frame of image, one partial image display portion is formed by at least one scanning line driver circuit and at least one signal line driver circuit. That is, plural partial image display portions together create one display device. Hence, the assemblage of the partial image display portions displays one frame of image.

Each individual partial image display portion has a fewer number of scanning lines and a fewer number of signal lines than those used when one full image is displayed. Therefore, the time taken to drive the scanning lines and signal lines and to supply signals can be made longer than conventional.

Accordingly, if TFTs operating at lower speeds are used to drive the lines, a display can be provided in the same manner. This can reduce the cost.

If TFTs operating at the same speed as conventionally used TFTs are used to activate the lines, the number of pixels contained in the whole display device can be increased.

As an example, the whole display device has two scanning line driver circuits and two signal line driver circuits. Where each partial image display portion is composed of one scanning line driver circuit and one signal line driver circuit, four partial image display portions are formed.

We now assume that the display device has 480 scanning lines and that 30 frames are produced per second. In the past, the time required to supply data about one scanning line has been required to be shorter than $1 \div 30 \div 480 = 69\ \mu s$. In the present invention, the time is $1 \div 30 \div 240 = 139\ \mu s$. Thus, a time twice as long as the prior art time is secured. In the prior art technique, one driver circuit can drive 480 lines. In the present invention, the same driver circuit can drive 960 lines.

The present invention permits an image to be displayed on a display device, especially on an electrooptical active matrix liquid crystal display, at a higher speed than conventional without the need to change the substantial operating speed of the driver on the gate side or of the driver on the source side and without the need to vary the clock frequency or other parameter. As a consequence, a high-speed, large-area display with high information content can be easily accomplished at low cost.

Other objects and features of the invention will appear in the course of the description thereof, which follows.

DESCRIPTION OF THE PREFERRED EMBODIMENTS

EXAMPLE 1

Figure 1:
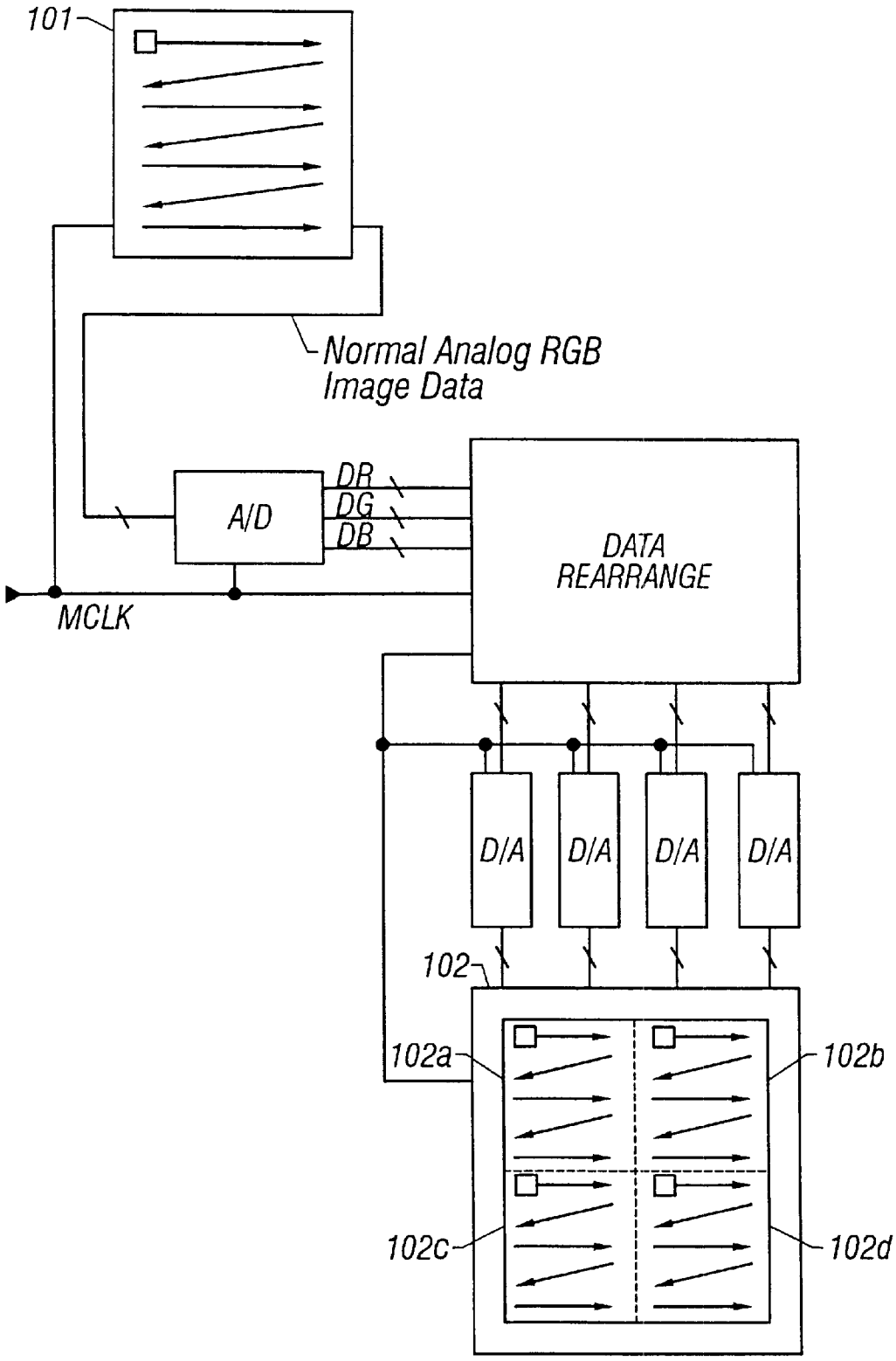
FIG. 1 is a block diagram of an image read-and-reproduction system according to Example 1 of the invention.

The configuration of the present example is briefly described by referring to FIG. 1. This example is an image read-and-reproduction system using a display device 102, such as an electrooptical liquid crystal display. An image is scanned and read by an image reader 101 as shown. The image is displayed, or reproduced, on four parts 102*a*, 102*b*, 102*c*, and 102*d* of the display device 102. The image 101 to be read is scanned in two directions. This is referred to as the bidirectional scan. The image is read by the image reader 101 such as a video camera consisting of 2m×2n pixels. The operation of this image read-and-reproduction system is next described. The image reader 101 produces an analog RGB signal to an A/D converter, which converts incoming analog data into digital form. The digital data from the A/D converter is rearranged into four sets of data by an image data rearranging unit. The four sets of data from the A/D converter are supplied to four D/A converters, respectively. The output data sets from the four D/A converters are fed to the display device 102, where the data sets are made visible.

Figure 2A:
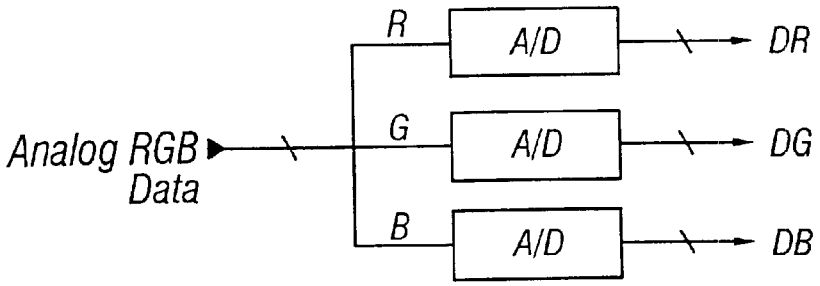
FIGS. 2A and 2B are diagrams of the A/D Converters and D/A converters shown in FIG. 1.
Figure 2B:
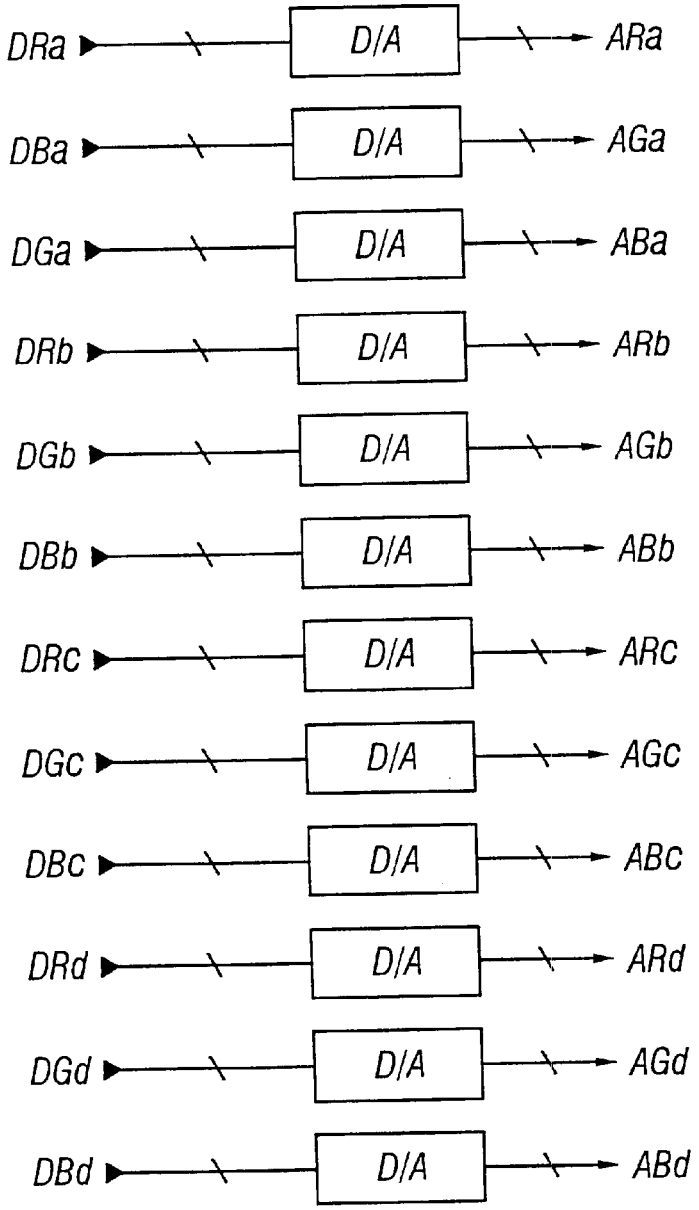

FIG. 2(*a*) shows an example of the A/D converter shown in FIG. 1. FIG. 2(*b*) shows an example of the set of D/A converters shown in FIG. 1. The A/D converter is an 8-bit (256 gray levels) analog-to-digital converter. Also, each D/A converter is an 8-bit digital-to-analog converter. The number of bits may be increased or reduced according to the number of gray levels to be displayed.

Figure 3:
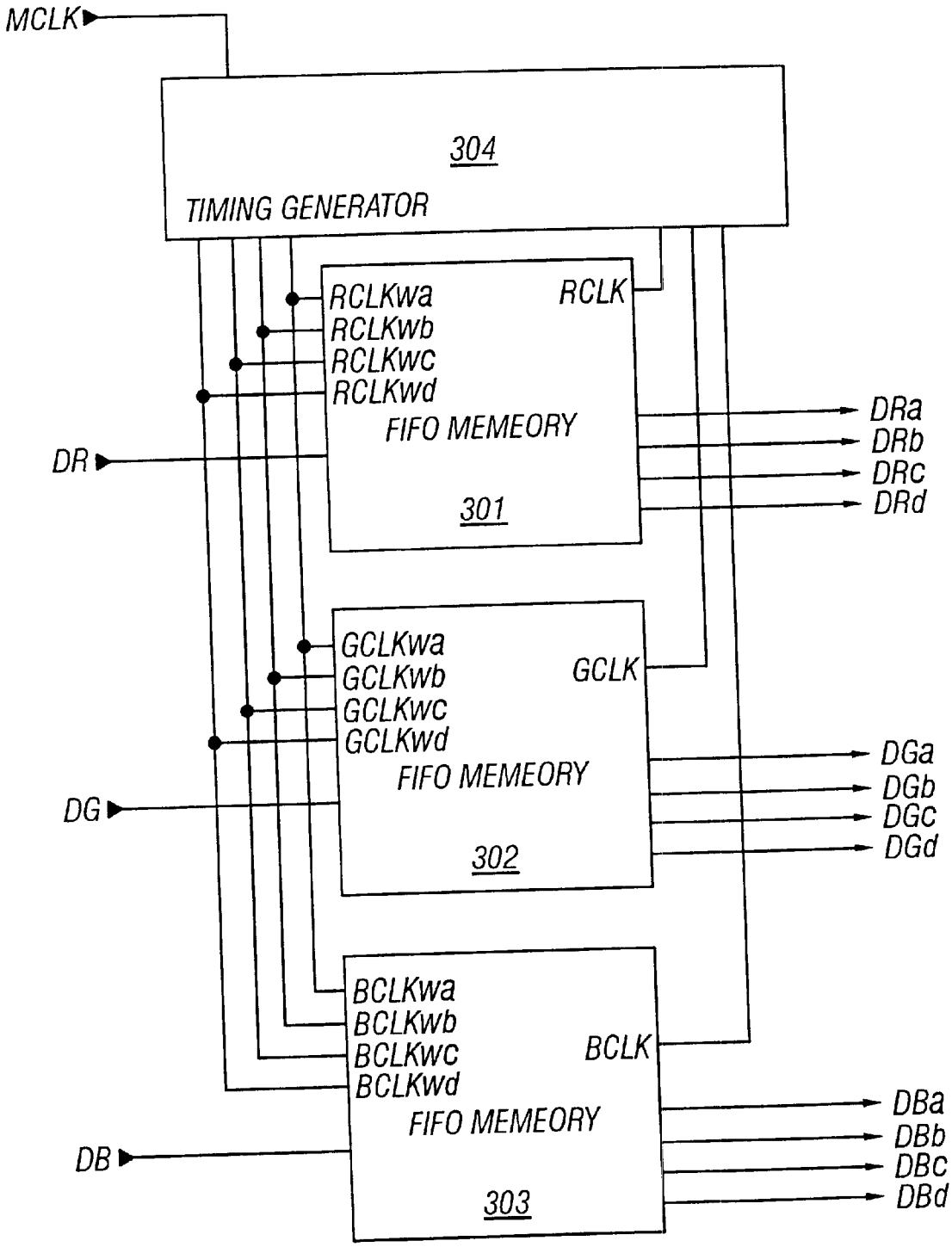
FIG. 3 is a diagram of the image data rearranging unit shown in FIG. 1.

An example of the image data rearranging unit shown in FIG. 1 is particularly shown in FIG. 3. This image data rearranging unit comprises FIFO (first in first out) memories 301–303 and a timing generator 304 for generating a timing signal for synchronizing writing and reading to and from the FIFO memories 301–303. These FIFO memories 301–303 rearrange digital data about the three primary colors, or R, G, and B, into four sets of data corresponding to the four image display portions.

Figure 4:
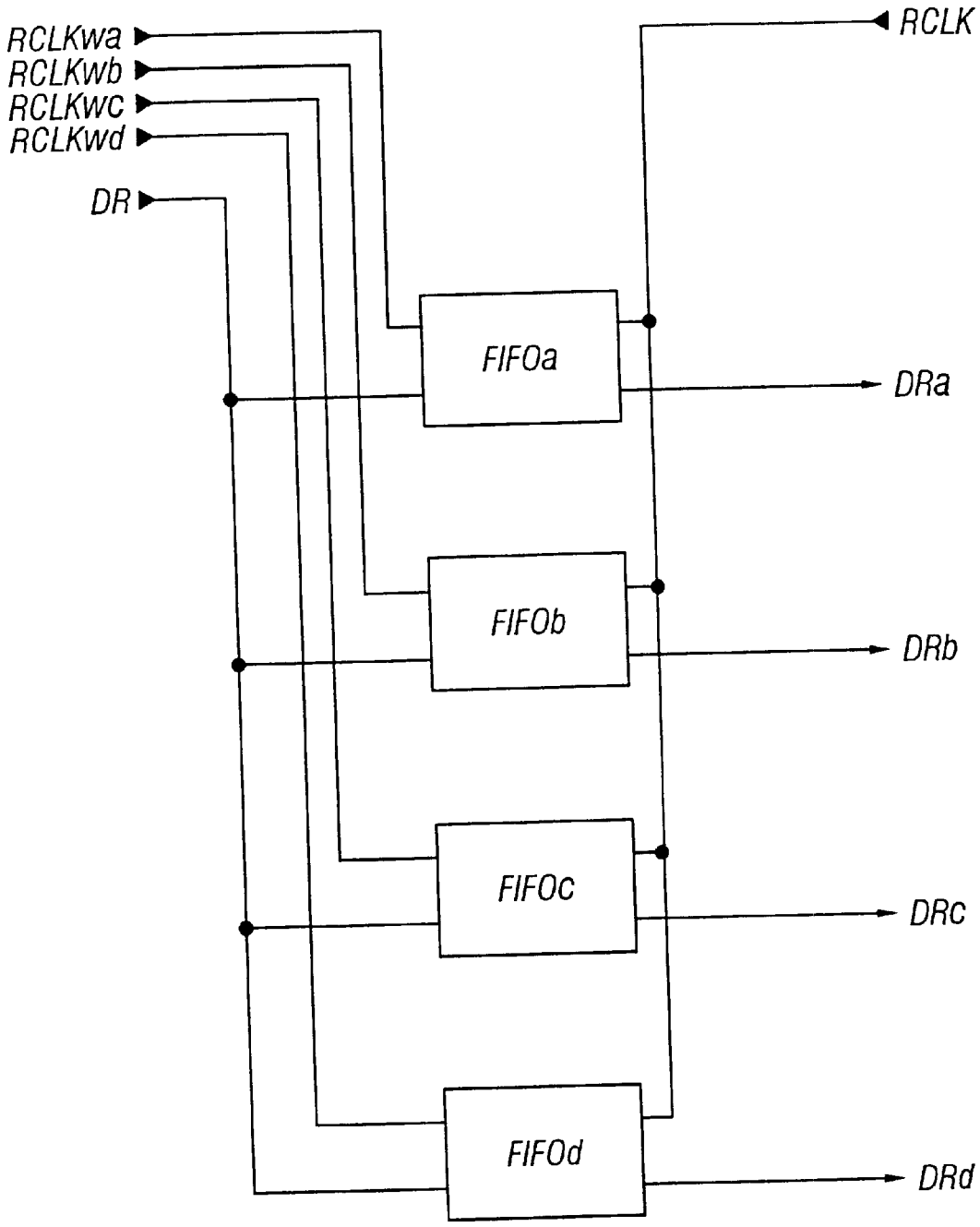
FIG. 4 is a diagram of an FIFO memory for an R signal, the FIFO memory being used in the system shown in FIG. 1.

The FIFO memory associated with the R (red) signal is particularly shown in FIG. 4. The FIFO memories associated with the G (green) and B (blue) signals are similarly constructed. Data sets stored in FIFO memories FIFOa, FIFOb, FIFOc, and FIFOd are used to display four parts, respectively, of an image on the four image display portions 102*a*, 102*b*, 102*c*, and 102*d*, respectively, of the display device 102 shown in FIG. 1.

Figure 5:
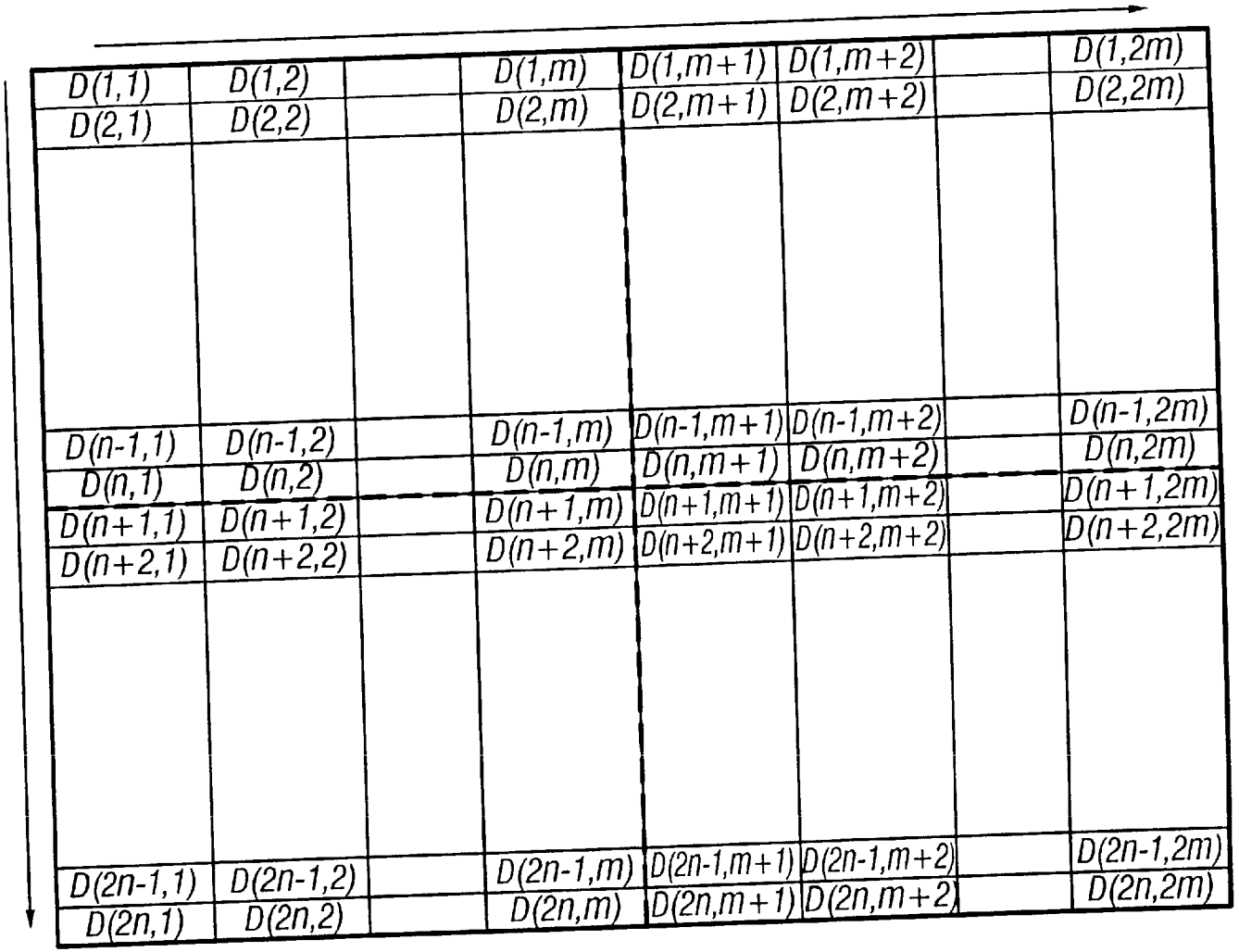
FIG. 5 is a diagram showing the relation between image data that is read out and a displayed image.

The operation of the image data rearranging unit with respect to the R signal is described now. The image data rearranging unit operates similarly with respect to the G and B signals. The image data produced from the image reader 101 shown in FIG. 1 is supplied to the A/D converter. The output signal from this A/D converter is particularly shown in FIG. 5.

Figure 6A:
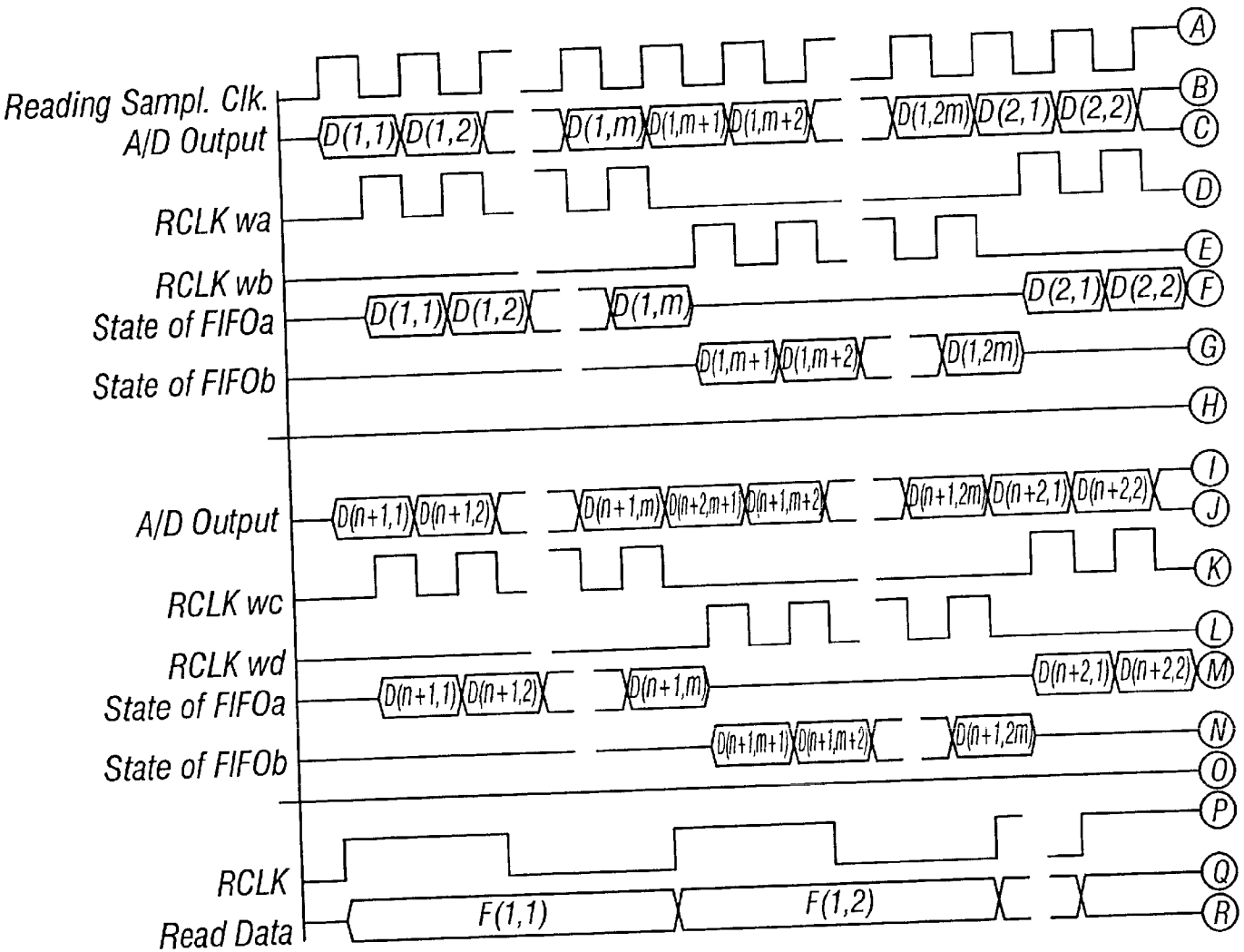
FIGS. 6A and 6B are timing charts, illustrating the operation of the image data rearranging unit shown in FIG. 3.
Figure 6B:
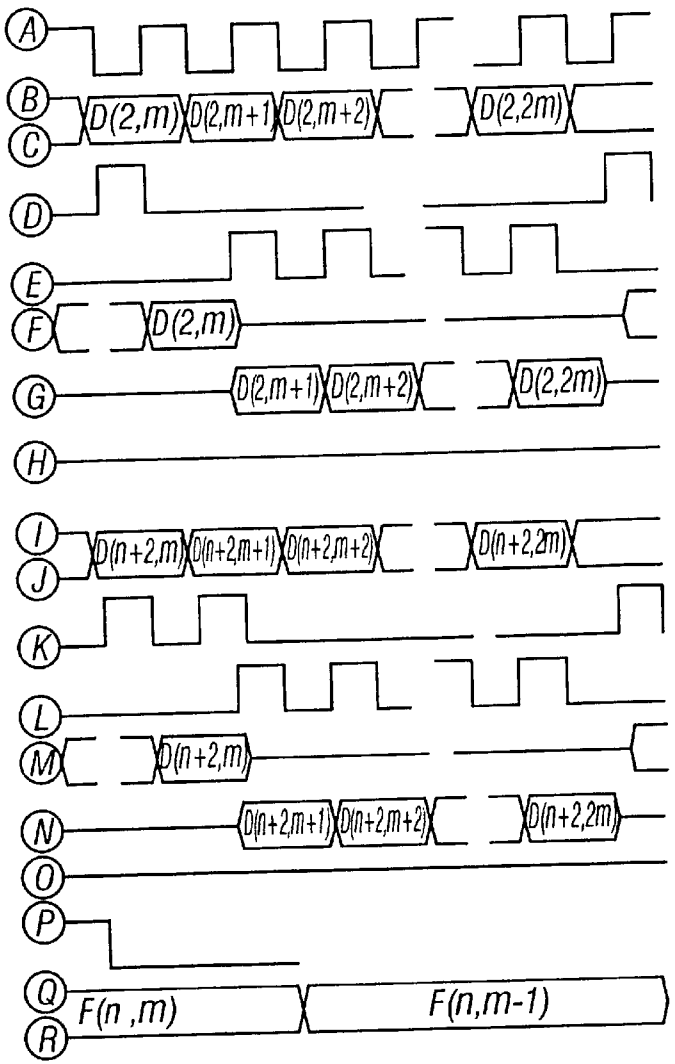

FIGS. 6A and 6B are timing charts illustrating writing and reading to and from the FIFO memories. The image data is delivered from the A/D converter in synchronism with main clock pulses and written into the memory FIFOa in synchronism with writing clock pulses RCLKwa. When writing is done up to the m-th column of the first row, the writing clock pulses RCLKwa are caused to cease. Writing clock pulses RCLKwb are produced. Then, data is written into the memory FIFOb from the (m+1)th column.

These operations are repeated up to the pixel (n, 2m). Then, data is written into the memory FIFOc from the (n+1)th row. Then, data is written into the memory FIFOd from the (m+1)th column of the (n+1)th row. These operations are repeated to write data about one frame of image into the four FIFO memories.

Subsequently, the four sets of image data are read from the four FIFO memories simultaneously in synchronism with reading clock pulses RCLK. The sets data read out are concurrently transferred to the four parts of the display device 102, where the four sets of data are written, as shown in FIG. 1.

Figure 7:
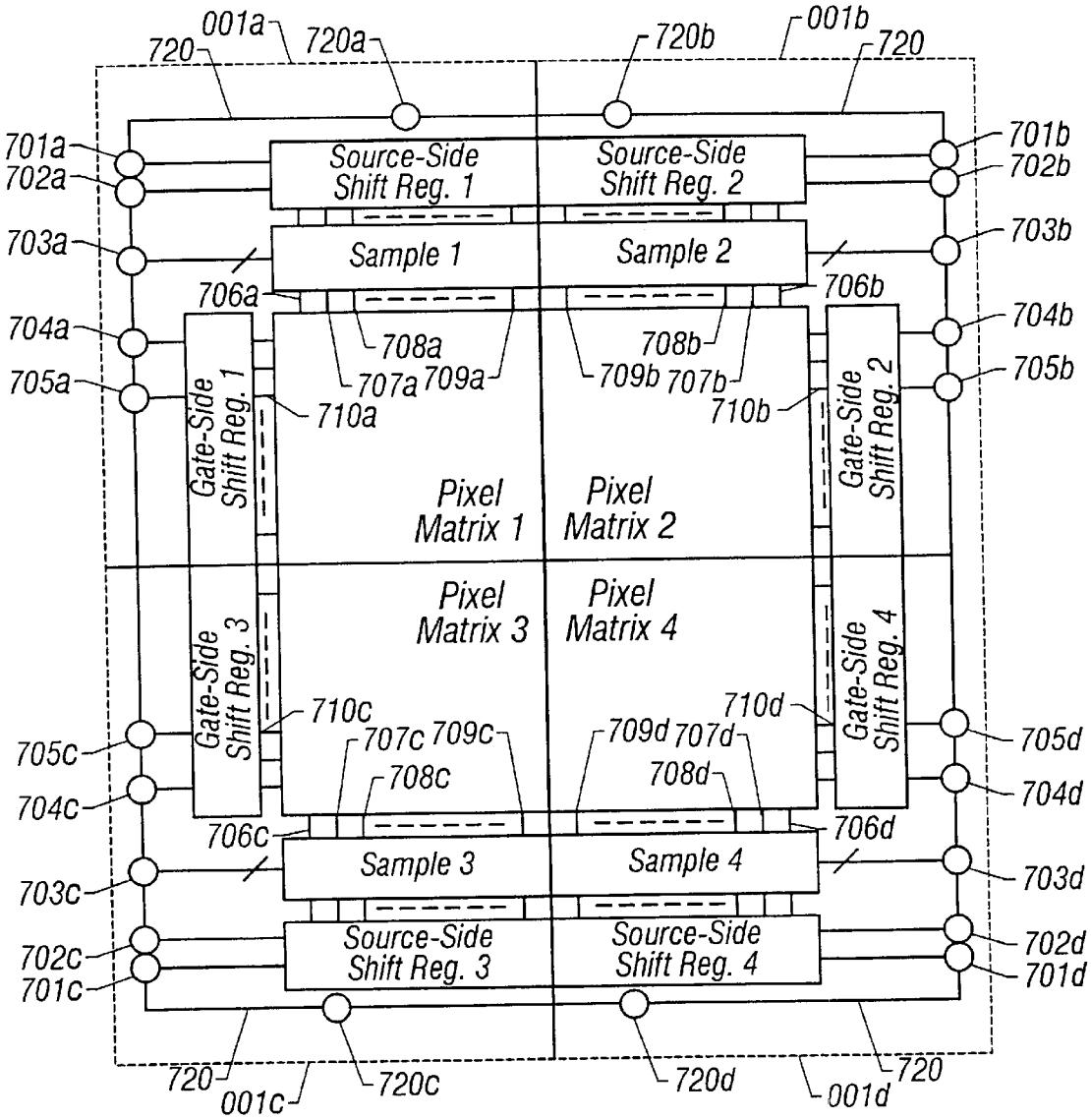
FIG. 7 is a circuit diagram of the electrooptical liquid crystal display used in the system shown in FIG. 1.

The display device 102 is next described by referring to FIG. 7. The partial image display portions 001*a*, 001*b*, 001*c*, and 001*d* are similar in structure to the prior art electrooptical active matrix liquid crystal display.

Referring to FIG. 7, the partial image display portion 001*a* comprises a source-side shift register a consisting of P-type TFTs, N-type TFTs, or complementary TFTs, a sampling circuit consisting of TFTs, a gate-side shift register a consisting of P-type TFTs, N-type TFTs, or complementary TFTs, a source-side start pulse input terminal 701*a*, a source-side shift clock input terminal 702*a*, an analog RGB input terminal 703*a*, a gate-side start pulse input terminal 704*a*, and a gate-side shift clock input terminal 705*a*. Similarly, the partial image display portion 001*b* comprises a source-side shift register b consisting of P-type TFTs, N-type TFTs, or complementary TFTs, a sampling circuit consisting of TFTs, a gate-side shift register b consisting of P-type TFTs, N-type TFTs, or complementary TFTs, a source-side start pulse input terminal 701*b*, a source-side shift clock input terminal 702*b*, an analog RGB input terminal 703*b*, a gate-side start pulse input terminal 704*b*, and a gate-side shift clock input terminal 705*b*. The partial image display portion 001*c* comprises a source-side shift register c consisting of P-type TFTs, N-type TFTs, or complementary TFTs, a sampling circuit consisting of TFTs, a gate-side shift register c consisting of P-type TFTs, N-type TFTs, or complementary TFTs, a source-side start pulse input terminal 701*c*, a source-side shift clock input terminal 702*c*, an analog RGB input terminal 703*c*, a gate-side start pulse input terminal 704*c*, and a gate-side shift clock input terminal 705*c*. The partial image display portion 001*d* comprises a source-side shift register d consisting of P-type TFTs, N-type TFTs, or complementary TFTs, a sampling circuit consisting of TFTs, a gate-side shift register d consisting of P-type TFTs, N-type TFTs, or complementary TFTs, a source-side start pulse input terminal 701*d*, a source-side shift clock input terminal 702*d*, an analog RGB input terminal 703*d*, a gate-side start pulse input terminal 704*d*, and a gate-side shift clock input terminal 705*d*.

The number of the pixels in the vertical direction of each partial image display portion is half the number of the pixels in the vertical direction of the whole electrooptical liquid crystal display. Also, the number of the pixels in the horizontal direction of each partial image display portion is half the number of the pixels in the horizontal direction of the whole electrooptical liquid crystal display. The partial image display portions 001*a*, 001*b*, 001*c*, and 001*d* are equipped with counter electrodes 720*a*, 720*b*, 720*c*, and 702*d*, respectively.

The operation of the whole electrooptical liquid crystal display is next described. The partial image display portions 001*a*, 001*b*, 001*c*, and 001*d* are similar in operation to the prior art display device and so operation of these partial display portions will not be described below.

When gate-side shift clock pulses and gate-side start pulses are applied from the gate-side start pulse input terminals 704*a*, 704*b*, 704*c*, and 704*d* and from the gate-side shift clock input terminals 705*a*, 705*b*, 705*c*, and 705*d*, the switching transistors at the pixels of the first row of the partial image display portions 001*a*, 001*b*, 001*c*, and 001*d*, are turned on. At this time, if source-side start pulses and source-side shift clock pulses are applied from the source-side start pulse input terminals 701*a*, 701*b*, 701*c*, and 701*d* and from the source-side shift clock input terminals 702*a*, 702*b*, 702*c*, and 702*d*, then the image data entered from the analog RGB input terminals 703*a*, 703*b*, 703*c*, and 703*d* are sampled by their respective sampling circuits 1, 2, 3, and 4, so that the first pixels a(7, 1), b(1, 1), c(1, 1), and d(1, 1) of the partial image display portions 001*a*, 001*b*, 001*c*, and 001*d*, respectively, are activated. As a result, the image data is visualized.

Figure 8:
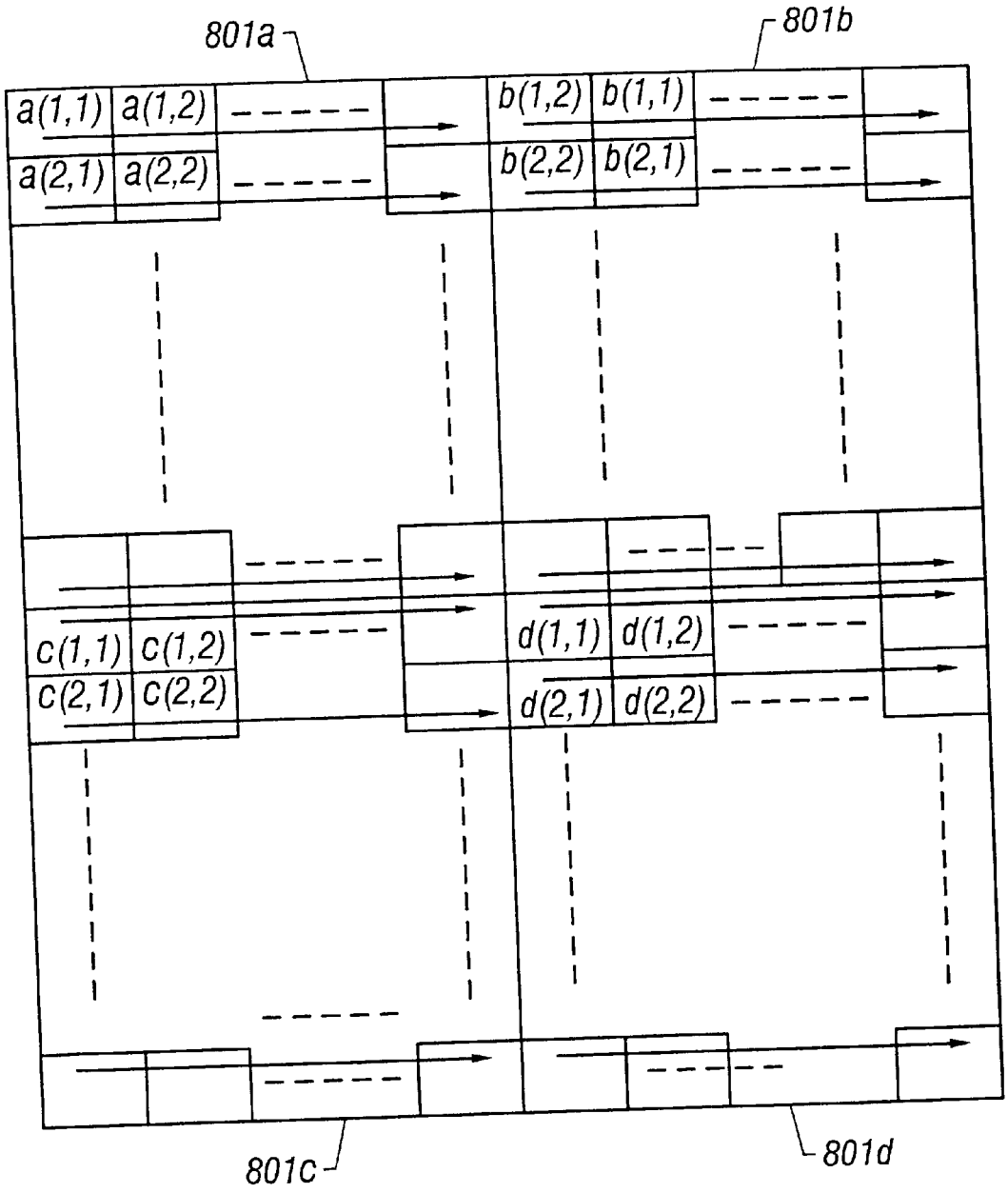
FIG. 8 is a diagram, illustrating the manner in which an image is displayed by the liquid crystal display shown in FIG. 7.

These operations are repeated. Thus, the first rows of the partial image display portions 001*a*, 001*b*, 001*c*, and 001*d* are activated. The aforementioned operations are repeated to activate the second rows of the partial image display portions 007*a*, 007*b*, 007*c*, and 007*d*. These operations are repeated so as to activate all the rows of the partial image display portions 007*a*, 007*b*, 007*c*, and 007*d*. Hence, one frame of image is fully displayed. Operations performed for this display are illustrated in FIG. 8.

The four partial image display portions, or four active matrix panels, located at four different locations provide displays at the same time. The four image display portions cooperate to draw one full image.

At this time, four separate voltages may be applied to the four counter electrodes 720*a*, 720*b*, 720*c*, and 720*d*. Alternatively, the four partial image display portions may be internally shorted to each other to form a common counter electrode, and a voltage may be applied to this common counter electrode.

In this example, four partial pixel matrixes 801*a*, 801*b*, 801*c*, and 801*d* are not required to have the same size. However, where the balance among the four image display portions is taken into consideration, the four partial display portions have preferably the same size. As an example, where the whole device consists of a 640×480 pixel matrix, each of the four partial pixel matrices 801*a*, 801*b*, 801*c*, and 801*d* comprises a 320×240 pixel matrix.

Figure 9A:
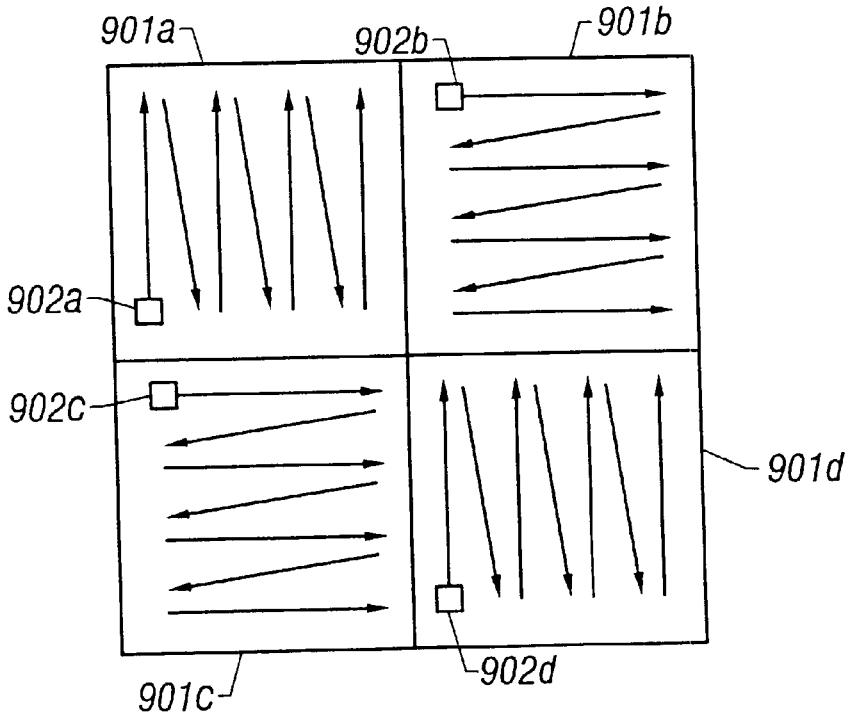
FIGS. 9(*a*) and 9(*b*) are diagrams, illustrating examples of scan made by the liquid crystal display shown in FIG. 7.
Figure 9B:
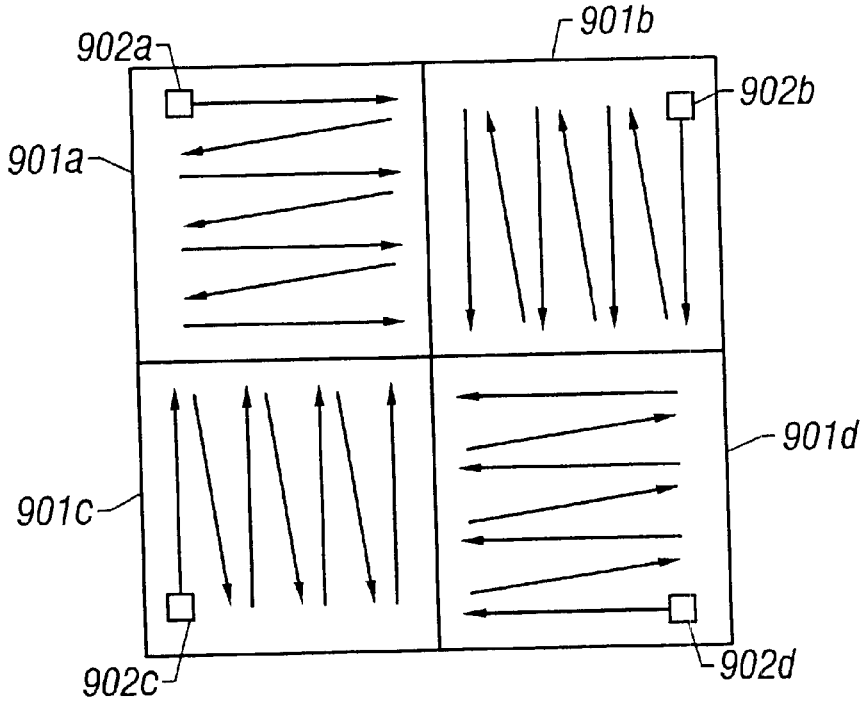

The image data may be displayed in any arbitrary manner as illustrated in FIGS. 9(*a*) and 9(*b*). In this example, the horizontal sampling frequency of the source-side drivers is ¼ of the horizontal sampling frequency conventionally adopted. The vertical sampling frequency of the source-side drivers is ½ of the vertical sampling frequency conventionally adopted.

EXAMPLE 2

Figure 10:
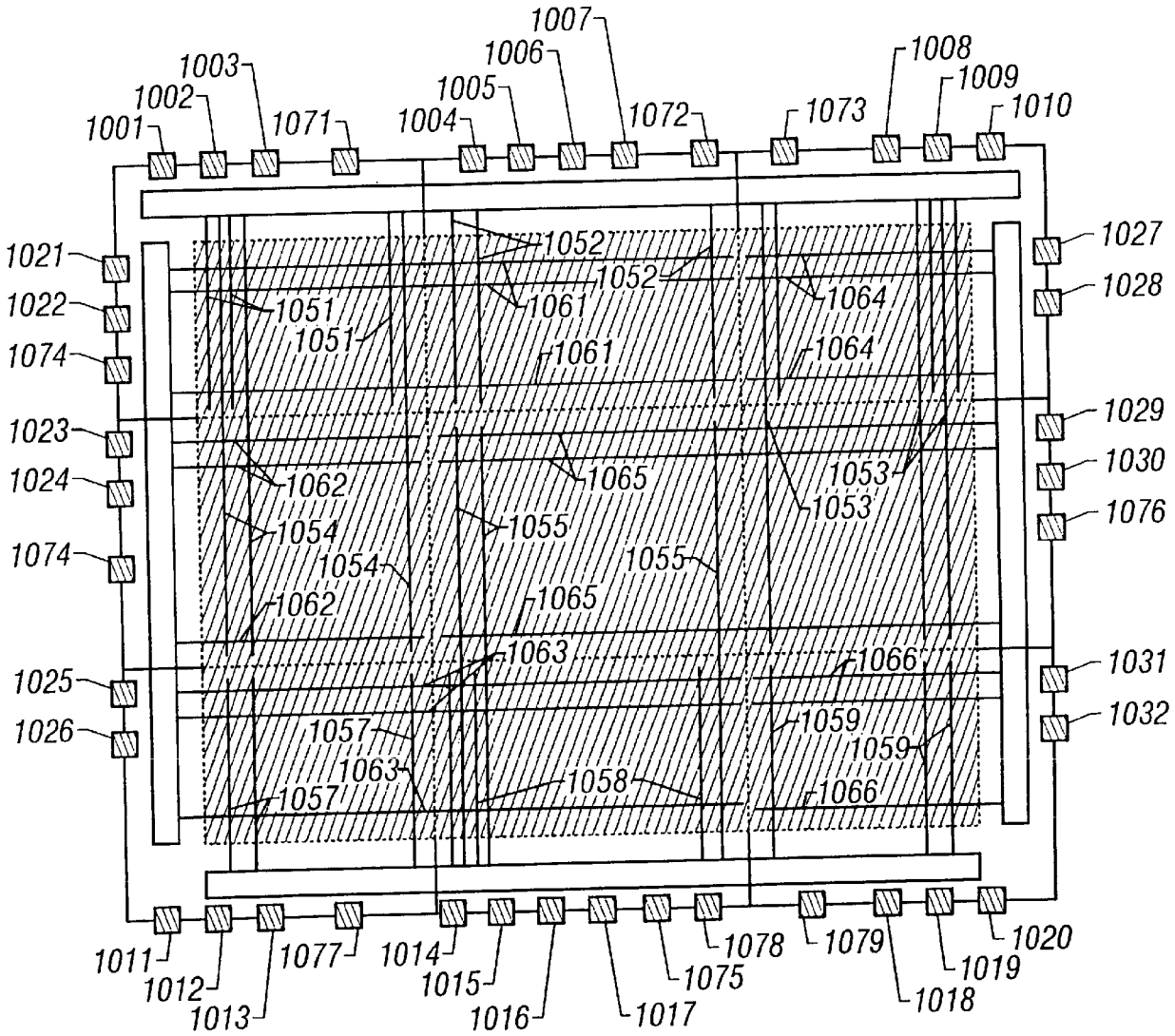
FIG. 10 is a circuit diagram of an electrooptical liquid crystal display according to Example 2 of the invention.

In this example, the whole display device is divided into 9 partial image display portions which can provide displays independently, as shown in FIG. 10. Rearrangement of image data can be easily done by increasing the number of FIFO memories used in Example 1. Therefore, only the display portions of this display device are described below.

Figure 11A:
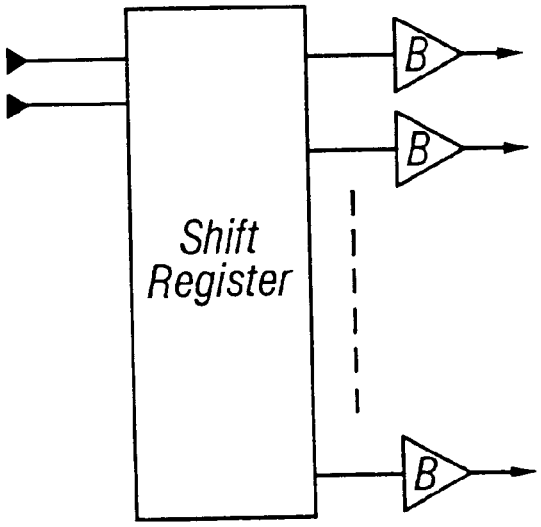
FIGS. 11(*a*) and 11(*b*) are circuit diagrams, illustrating the driving performance of the gate-side drivers shown in FIG. 10.
Figure 11B:
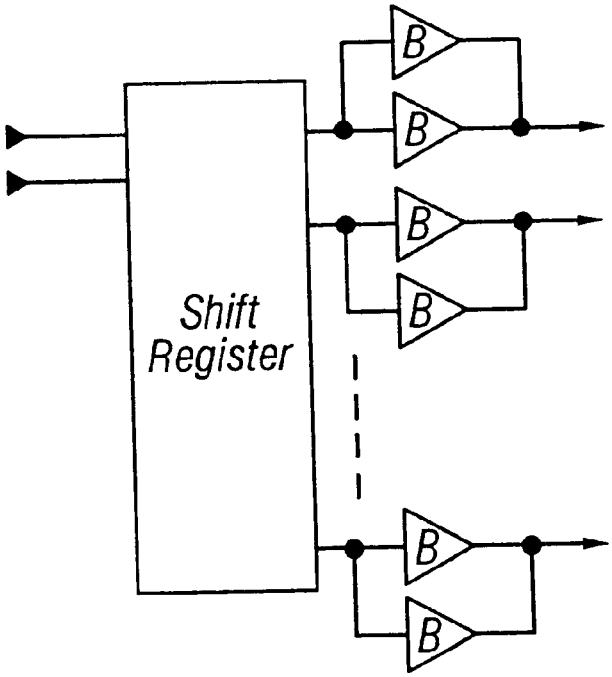

Gating signals are supplied to the pixel matrixes 1 and 2 from the gate-side driver 1. A gating signal is supplied to the pixel matrix 4 from the gate-side driver 2. Gating signals are supplied to the pixel matrices 7 and 8 from the gate-side driver 3. A gating signal is supplied to the pixel matrix 3 from the gate-side driver 4. Gating signals are supplied to the pixel matrixes 5 and 6 from the gate-side driver 5. A gating signal is supplied to the pixel matrix 9 from the gate-side driver 6. Therefore, it is necessary that the capability of the gate-side drivers 1, 3, 5 to drive the gate lines be greater than the capability of the gate-side drivers 2, 4, and 6. Preferably, the former capability is about twice as great as the latter capability. Examples of the configuration of the gate drivers 1–6 are shown in FIGS. 11(*a*) and 11(*b*).

Referring back to FIG. 10, the counter electrodes of pixel matrixes 1–9 are indicated by numerals 1071–1079, respectively. Separate voltages may be applied to these counter electrodes. In a modified example, a common voltage may be applied to pixel matrixes driven by a common source driver. In a further modified example, the pixel matrixes may be connected so as to form pixel matrix subassemblies, and a voltage is applied to each subassembly. In this case, the number of counter electrodes is equal to the number of the pixel matrix subassemblies.

Source signal lines extend to pixel matrixes 1 and 4 from the source-side driver 1. Source signal lines extend to a pixel matrix 2 from the source-side driver 2. Source signal lines extend to pixel matrixes 3 and 6 from the source-side driver 3. Source signal lines extend to a pixel matrix 7 from the source-side driver 4. Source signal lines extend to pixel matrixes 5 and 8 from the source-side driver 5. Source signal lines extend to a pixel matrix 9 from the source-side driver 6.

Figure 12:
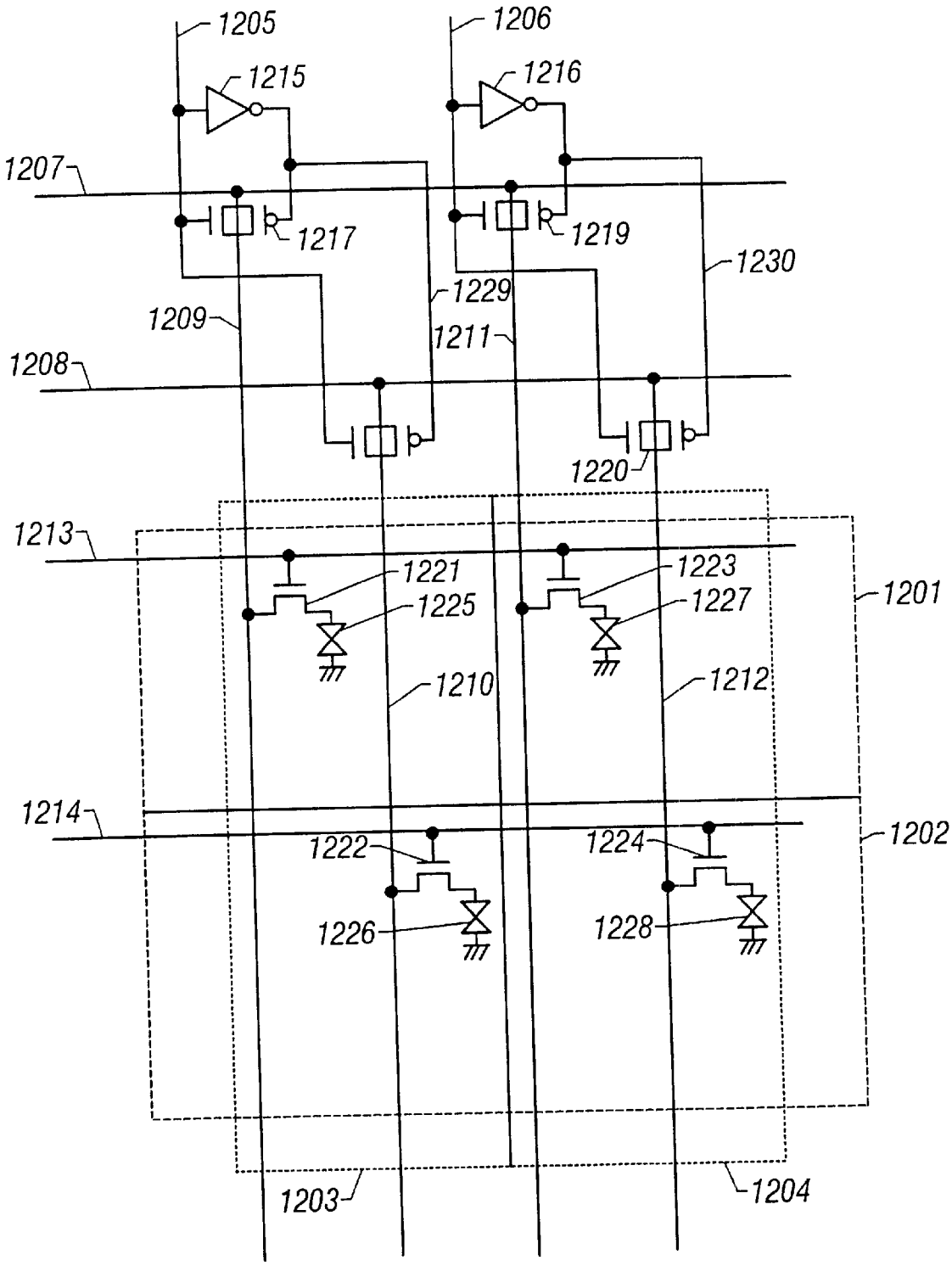
FIG. 12 is a fragmentary circuit diagram of a sampling circuit used in the liquid crystal display shown in FIG. 10.

The sampling circuits in the source-side drivers 1, 3, and 5 are shown in FIG. 12 and different in configuration from the sampling circuits in the source-side drivers 2, 4, and 6 which are the same as the prior art sampling circuit.

Figure 13:
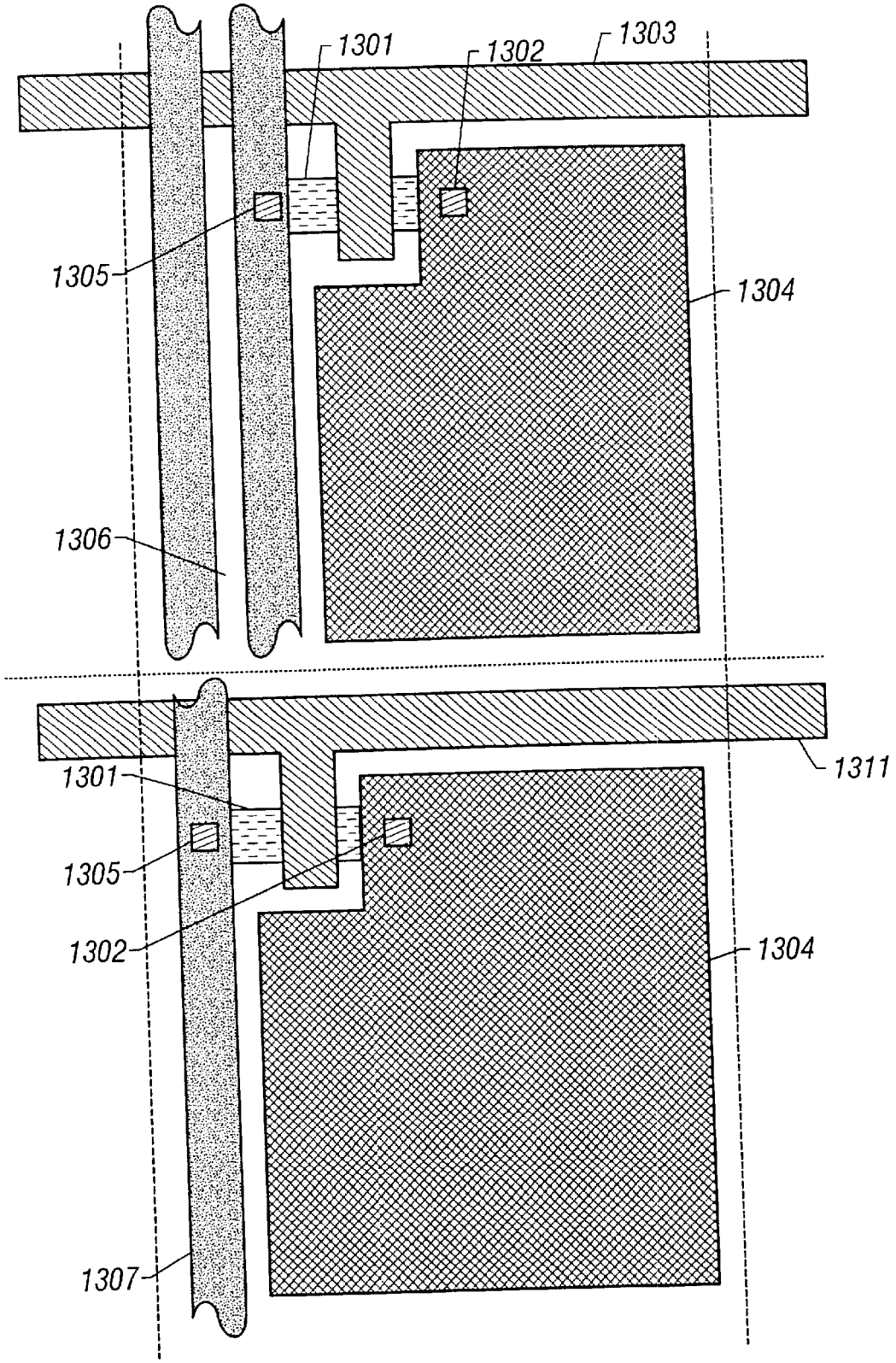
FIG. 13 is a diagram, illustrating the layout of some pixel matrices in the liquid crystal display shown in FIG. 10.
Figure 14:
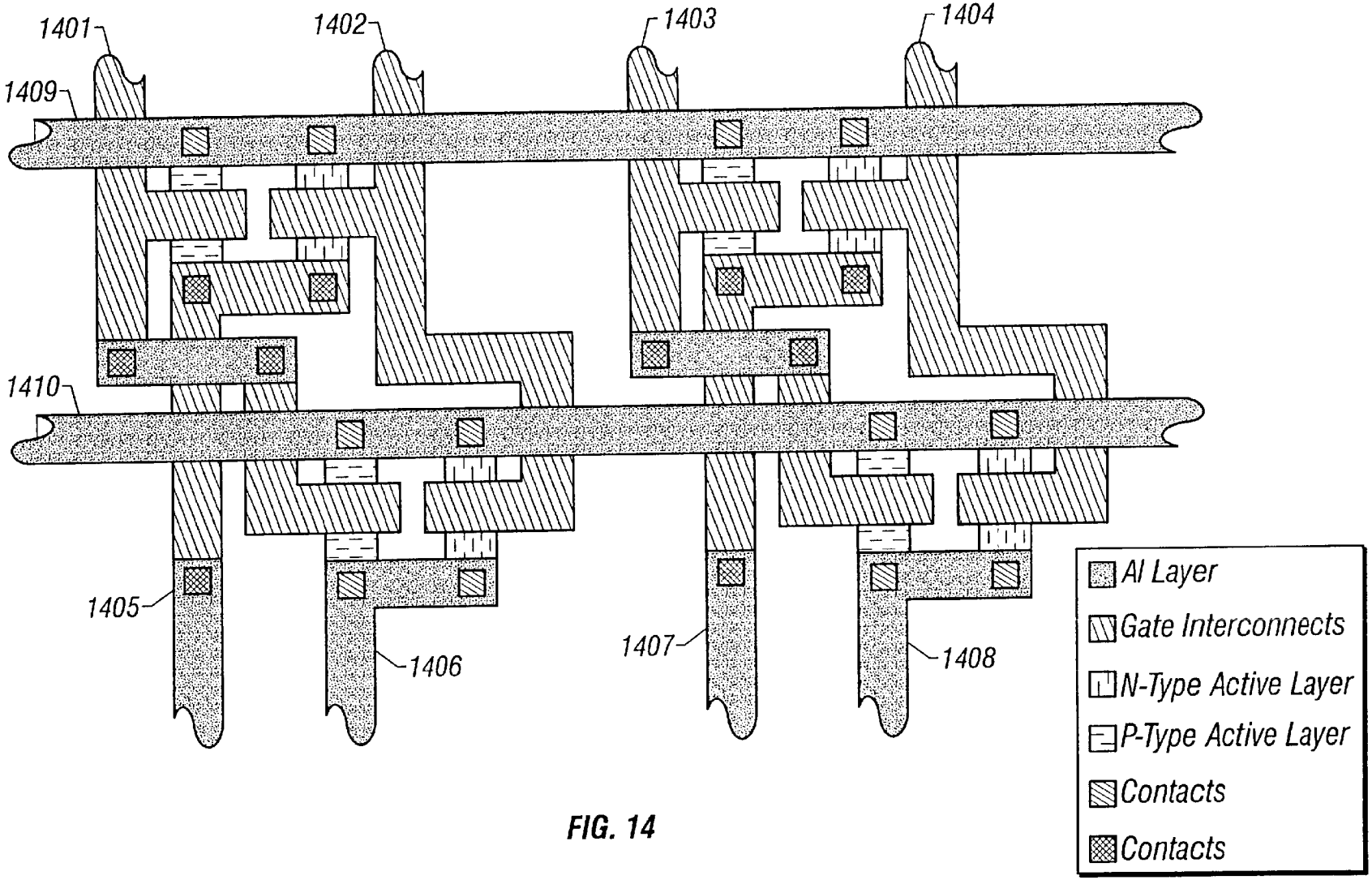
FIG. 14 is a diagram, illustrating the layout of a sampling circuit used in the liquid crystal display shown in FIG. 10.

The layout of the conductive interconnects shown in FIG. 12 is shown in FIGS. 13 and 14. In FIG. 13, aluminum interconnects 1306 and 1307 correspond to interconnects 1209 and 1210 or interconnects 1211 and 1212. Gate interconnects 1303 and 1309 correspond to interconnects 1213 and 1214.

In FIG. 14, aluminum interconnects 1401, 1402, 1403, 1404, 1405, 1406, 1407, and 1408 correspond to interconnects 1205, 1206, 1229, 1206, 1230, 1209, 1210, 1211, and 1212 shown in FIG. 12.

Figure 15:
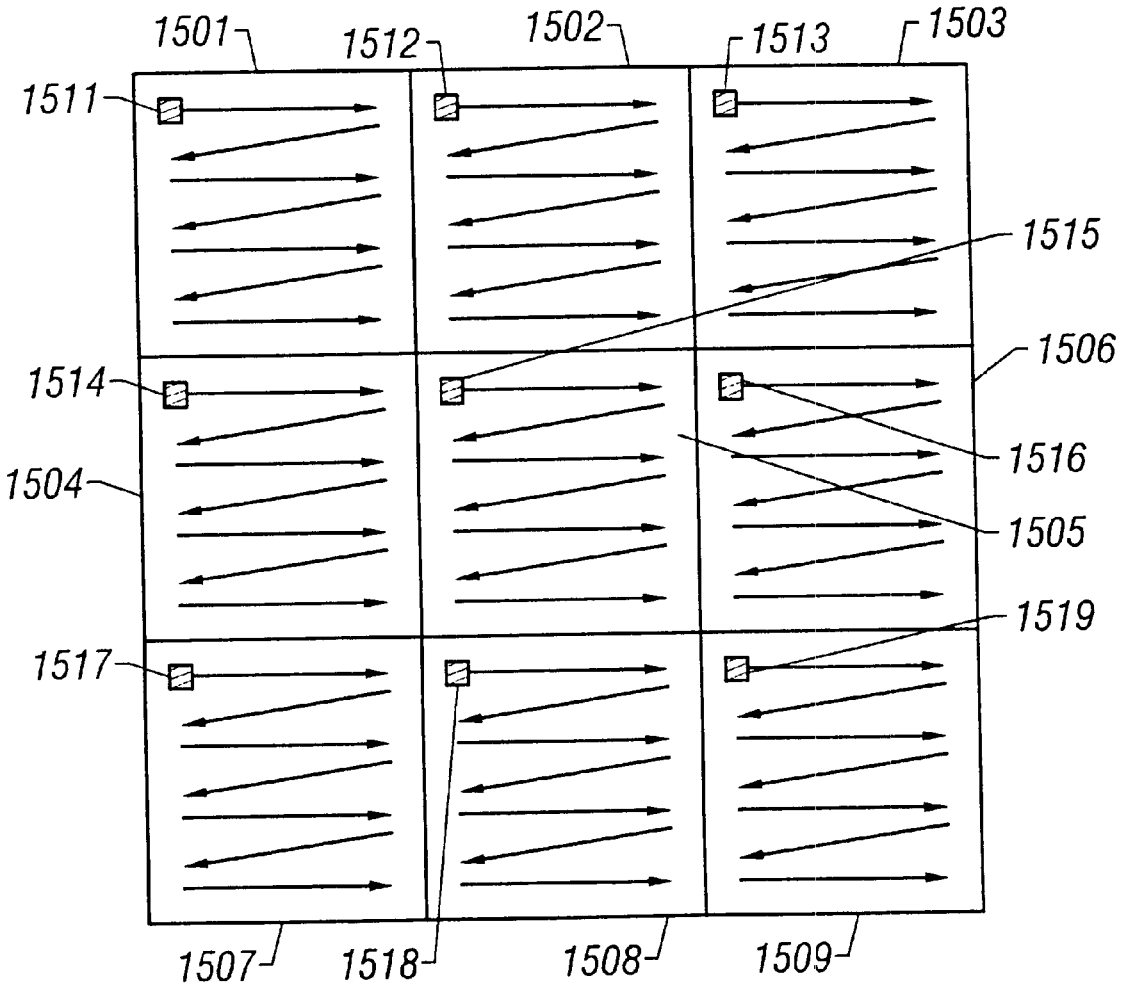
FIG. 15 is a diagram, illustrating an example of scan made by the liquid crystal display shown in FIG. 10.

In Example 2, the gate-side drivers 1–6 and the source-side drivers 1–6 may be combined arbitrarily. Also, a display may be provided in any arbitrary manner. An example of the combination and an example of the manner of display are shown in FIG. 15.

EXAMPLE 3

Example 3 is similar to Example 2 except for multilayer metallization structure. That is, the source-side drivers, the gate-side drivers, and the partial active matrices of Example 2 are the same as their counterparts of Example 3.

Figure 16:
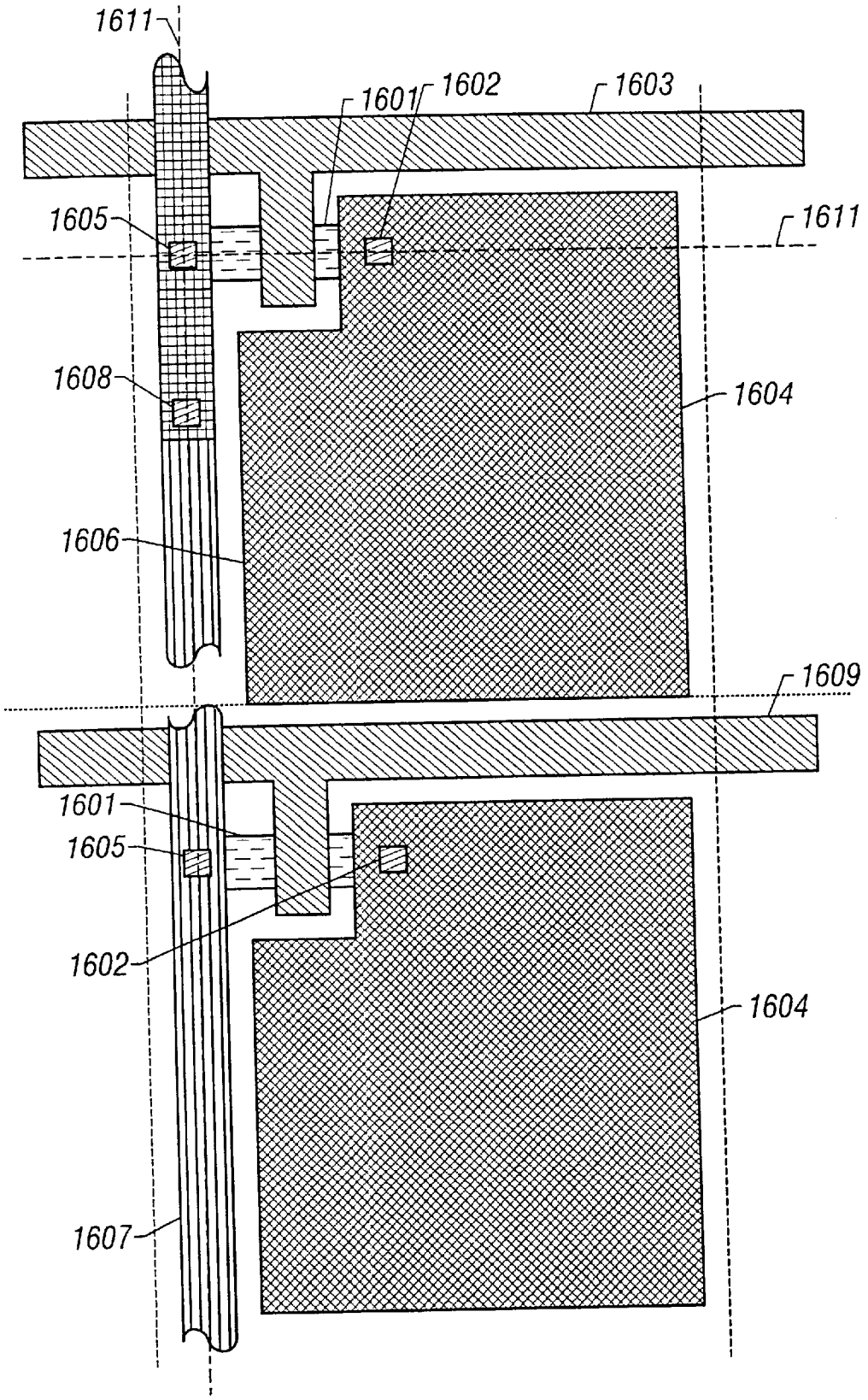
FIG. 16 is a diagram, illustrating the layout of some pixel matrices in a liquid crystal display according to Example 3 of the invention.
Figure 17:
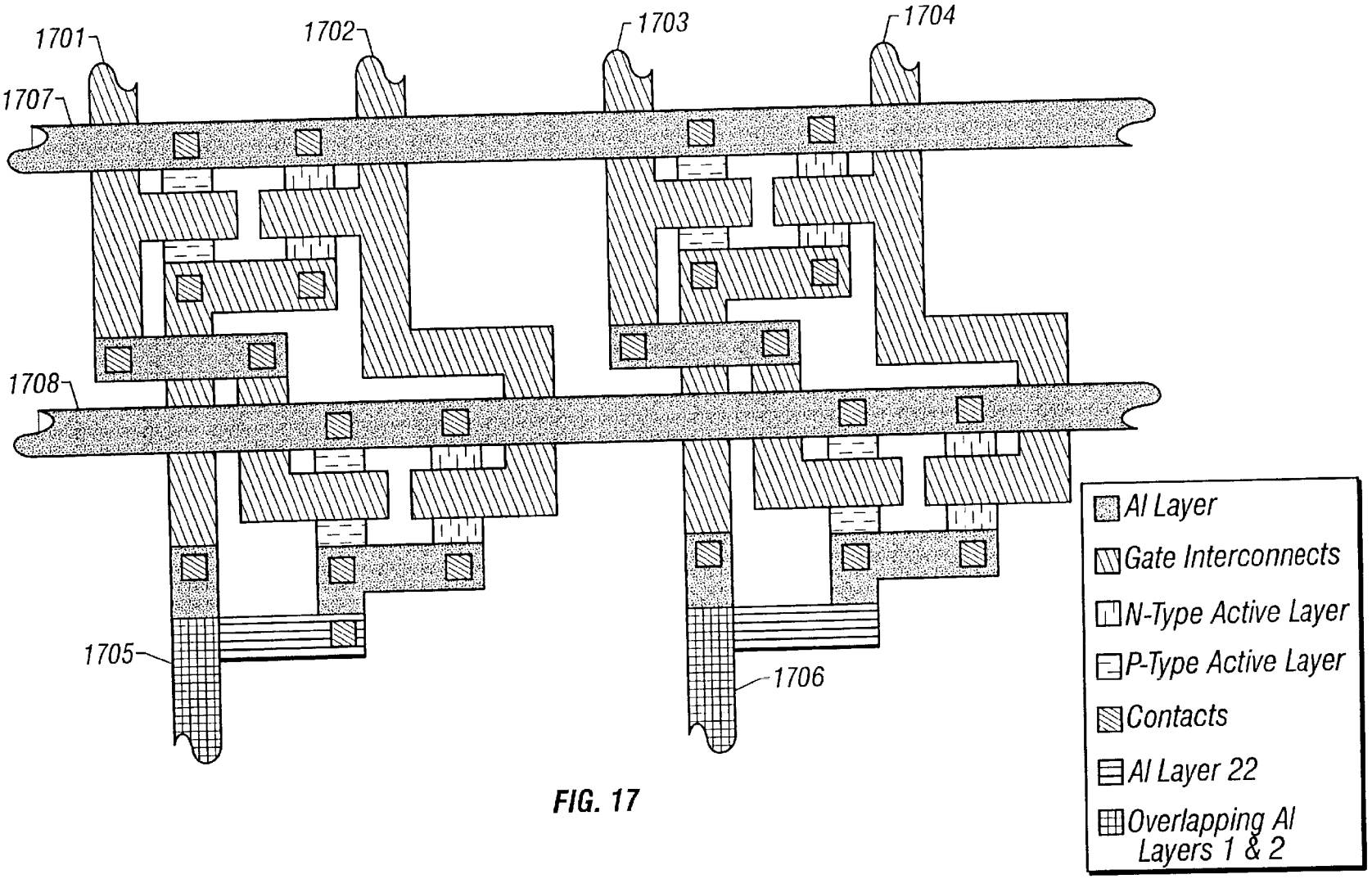
FIG. 17 is a diagram, illustrating the layout of a sampling circuit used in the liquid crystal display shown in FIG. 16.

In Example 2, the source signal lines of the source-side drivers 1, 3, and 5 per vertical line are twice as many as the source signal lines of the source-side driver circuits 2, 4, and 6 and, therefore, if the signal lines in the pixel matrices and the signal lines in the sampling circuits are only gate interconnects and aluminum interconnects as shown in FIGS. 13 and 14, then the aperture ratio of the pixel matrices 1, 3, and 8 deteriorate.

Where a multilayer metallization structure as shown in FIGS. 16 and 17 is employed, the operating speed can be improved without sacrificing the aperture ratio even if a plurality of driver circuits are used.

Figure 18:
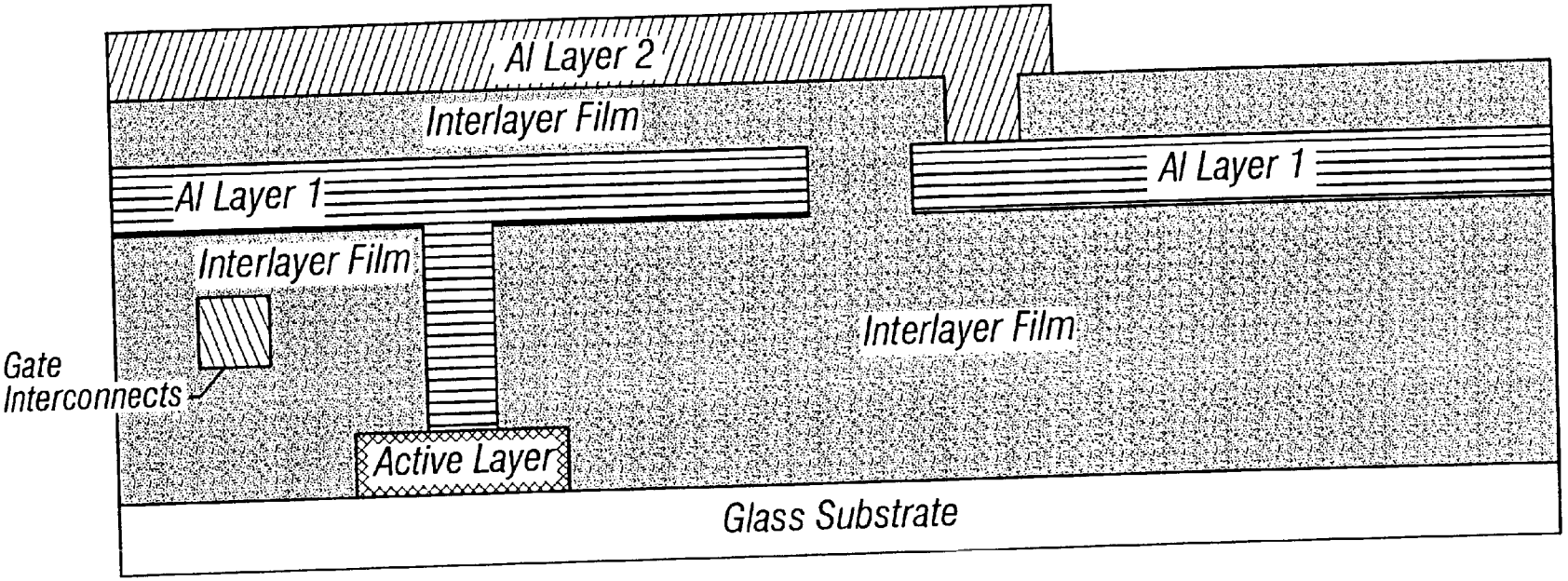
FIG. 18 is a cross-sectional view taken on plane 1010 of FIG. 9.
Figure 19:
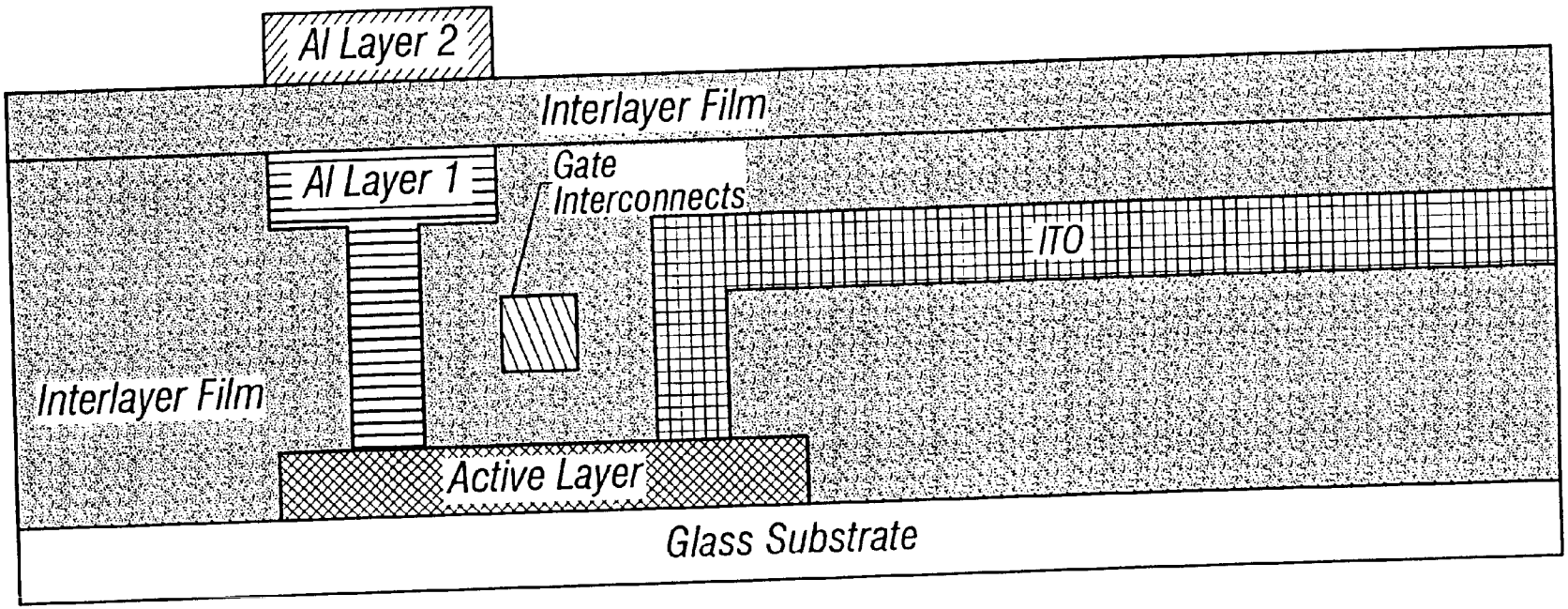
FIG. 19 is a cross-sectional view taken on plane 1011 of FIG. 9.
Figure 20:
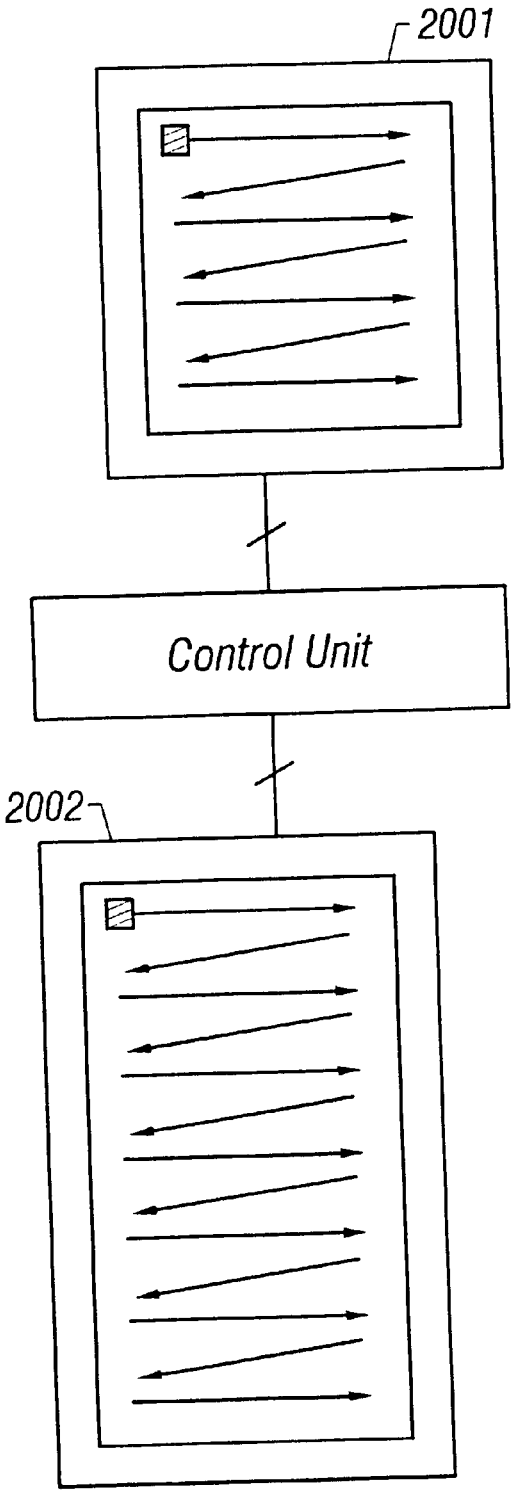
Fig. 20 (Prior Art)
FIG. 20 is a block diagram of the prior art display device.
Figure 21:
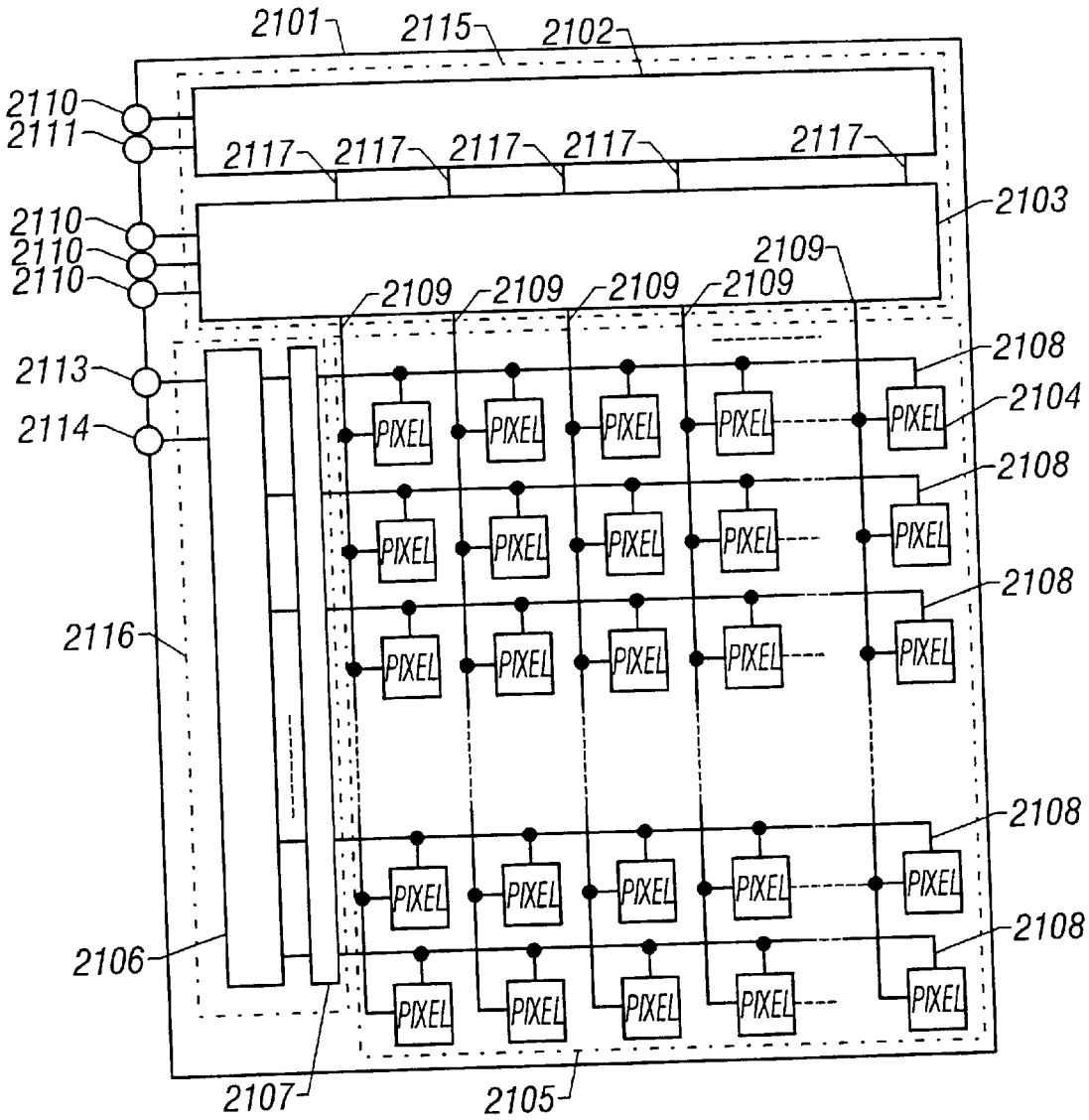
FIG. 21 (Prior Art)
FIG. 21 is a circuit diagram of the prior art electrooptical active matrix liquid crystal display.
Figure 22:
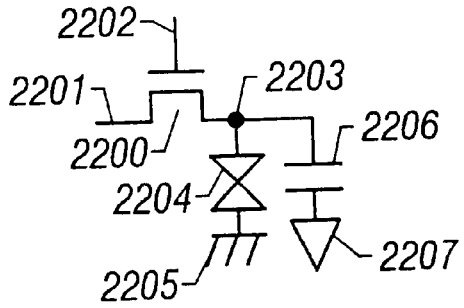
FIG. 22 (Prior Art)
FIG. 22 is a circuit diagram of one pixel formed by the prior art techniques.
Figure 23:
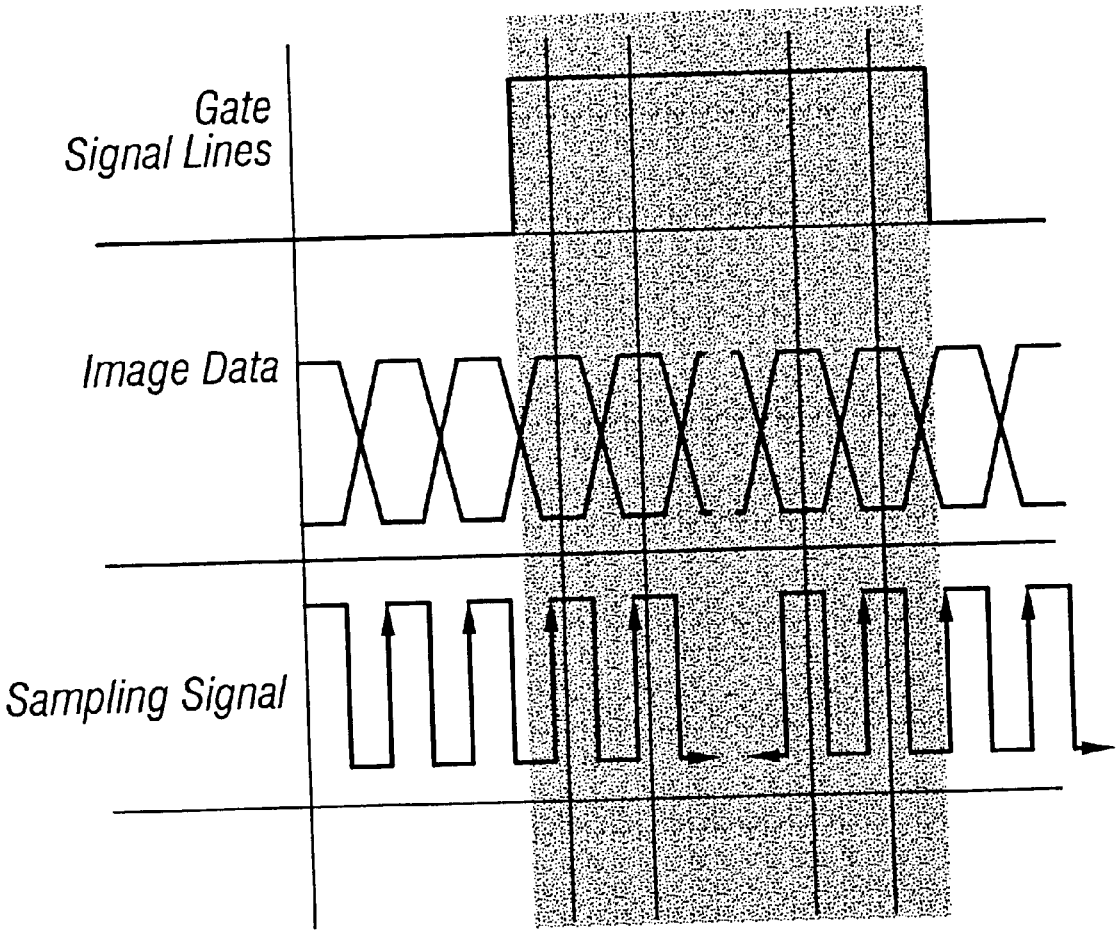
FIG. 23 (Prior Art)
FIG. 23 is a waveform diagram of the prior art display device.

In FIG. 16, overlapping aluminum interconnects 1 and 2 form two layers of metallization such as source lines 1209 and 1210 and source lines 1211 and 1212 shown in FIG. 12. In FIG. 16, gate interconnects 1601, 1602, 1603, and 1604 correspond to interconnects 1205, 1229, 1206, and 1230. Aluminum interconnects 1607 and 1608 correspond to interconnects 1207 and 1208. Aluminum interconnects 1605 and 1606 correspond to either interconnects 1209 and 1210 or interconnects 1211 and 1212. FIG. 18 is a cross-sectional view taken on 1610 of FIG. 16. FIG. 19 is a cross-sectional view taken on 1611 of FIG. 16.

The present invention permits an image to be displayed at a higher speed than conventional on a display device, especially on an electrooptical active matrix liquid crystal display, without varying the effective operating speeds of the gate-side drivers and of the source-side drivers and without varying the clock frequency or other parameter. A high-speed, large-area display with high information content can be easily accomplished at low cost.

What is claimed is:

1. A method of driving an active matrix display device, said active matrix display device comprising:

a substrate having at least a first portion and a second portion separate from the first portion;

a display region having at least first and second sections, each of the sections provided with an active matrix circuit comprising a plurality of pixel electrodes arranged in a matrix form and a plurality of switching elements for switching the pixel electrodes, wherein the first section is formed over the first portion of the substrate and the second section is formed over the second portion of the substrate;

first and second signal line driver circuits operating to supply image signals to the active matrix circuit of the first and second sections, respectively;

wherein the first and second signal line driver circuits are located outside the display region;

said method comprising:

displaying at the first and second sections at a same time to draw on full image, wherein the first and second signal driver circuits are operated so that the active matrix circuits of the first and second sections are scanned or driven in an opposite direction from each other.

2. The method according to claim 1 further comprising first and second FIFO memories corresponding to each of the active matrix circuits.

3. The method according to claim 1, wherein each of the first and second signal line driver circuits comprises shift register and a sampling circuit, said sampling circuit sampling inputted image signals in response to outputs of the shift register and supplying the sampled signals into the signal lines.

4. A method of driving an active matrix display device, said active matrix display device comprising:

a substrate having at least a first portion and a second portion separate from the first portion;

a display region having at least first and second sections defined on the substrate, each of said sections provided with an active matrix circuit comprising a plurality of pixel electrodes arranged in a matrix form and a plurality of switching elements for switching the pixel electrodes wherein the switching elements comprise thin film transistors formed over the substrate and wherein the first section is formed over the first portion of the substrate and the second section is formed over the second portion of the substrate;

first and second signal line driver circuits operating to supply image signals to the corresponding active matrix circuits, respectively, wherein the first and second signal line driver circuits comprise thin film transistors formed over the substrate;

wherein the signal line driver circuits are disposed on a peripheral portion of the substrate outside the display region;

said method comprising:

displaying at the first and second sections at a same time to draw on full image, wherein the first and second signal driver circuits are operated so that the active matrix circuits of the first and second sections are driven in an opposite direction from each other.

5. The method according to claim 4 further comprising first and second FIFO memories corresponding to each of the active matrix circuits.

6. The method according to claim 4, wherein each of the first and second signal line driver circuits comprises shift register and a sampling circuit, said sampling circuit sampling inputted image signals in response to outputs of the shift register and supplying the sampled signals into the signal lines.

7. A method of driving an active matrix display device, said active matrix display device comprising:

a substrate having at least a first portion and a second portion separate from the first portion;

a display region constituted with at least first and second sections, each of said sections provided with an active matrix circuit comprising a plurality of pixel electrodes arranged in a matrix form and a plurality of switching elements for switching the pixel electrodes, wherein the first section is formed over the first portion of the substrate and the second section is formed over the second portion of the substrate;

first and second scanning line driver circuits for scanning the active matrix circuit of the first and second sections, respectively;

wherein the first and second scanning line driver circuits are located outside the display region;

said method comprising:

displaying at the first and second sections at a same time to draw on full image, wherein the first and second scanning driver circuits are operated so that the active matrix circuits of the first and second sections are scanned in an opposite direction from each other.

8. The method according claim 7 wherein the first and second scanning line driver are operated so that the active matrix circuits of the first and second sections are scanned in an opposite direction from each other.

9. The method according to claim 7 further comprising first and second FIFO memories corresponding to each of the active matrix circuits.

10. The method according to claim 7 wherein each of the first and second scanning line driver circuits comprises shift register and a sampling circuit, said sampling circuit sampling inputted image signals in response to outputs of the shift register and supplying the sampled signals into the signal lines.

11. A method of driving an active matrix display device, said active matrix display device comprising:

a substrate having at least a first portion and a second portion separate from the first portion;

a display region constituted with at least first and second sections defined on the substrate, each of said sections provided with an active matrix circuit comprising a plurality of pixel electrodes arranged in a matrix form and a plurality of switching elements for switching the pixel electrodes wherein the switching elements comprise thin film transistors formed over the substrate and wherein the first section is formed over the first portion of the substrate and the second section is formed over the second portion of the substrate;

first and second scanning line driver circuits for scanning the active matrix circuits of the first and second sections, respectively, wherein the first and second signal line driver circuits comprise thin film transistors formed over the substrate;

wherein the scanning line driver circuits are disposed on a peripheral portion of the substrate outside the display region;

said method comprising:

displaying at the first and second sections at a same time to draw on full image, wherein the first and second scanning driver circuits are operated so that the active matrix circuits of the first and second sections are scanned in an opposite direction from each other.

12. The method according to claim 11 further comprising first and second FIFO memories corresponding to each of the active matrix circuits.

13. The method according to claim 11, wherein each of the first and second scanning line driver circuits comprises shift register and a sampling circuit, said sampling circuit sampling inputted image signals in response to outputs of the shift register and supplying the sampled signals into the signal lines.

* * * * *